US009981465B1

(12) United States Patent
Mu et al.

(10) Patent No.: US 9,981,465 B1
(45) Date of Patent: May 29, 2018

(54) INKJET PRINTING APPARATUS WITH FIRING OR HEATING WAVEFORM SELECTOR

(71) Applicant: RF Printing Technologies LLC, Pittsford, NY (US)

(72) Inventors: Richard Mu, Irvine, CA (US); Yonglin Xie, Rochester, NY (US)

(73) Assignee: RF Printing Technologies LLC, Pittsford, NY (US)

( * ) Notice: Subject to any disclaimer, the term of this patent is extended or adjusted under 35 U.S.C. 154(b) by 0 days. days.

(21) Appl. No.: 15/436,887

(22) Filed: Feb. 20, 2017

(51) Int. Cl.
*B41J 2/045* (2006.01)

(52) U.S. Cl.
CPC ..... *B41J 2/04541* (2013.01); *B41J 2/0455* (2013.01); *B41J 2/0458* (2013.01); *B41J 2/04508* (2013.01); *B41J 2/04563* (2013.01); *B41J 2/04588* (2013.01); *B41J 2202/13* (2013.01); *B41J 2202/20* (2013.01)

(58) Field of Classification Search
None
See application file for complete search history.

(56) References Cited

U.S. PATENT DOCUMENTS 4,982,199 A 1/1991 Dunn
5,036,337 A 7/1991 Rezanka
5,107,276 A 4/1992 Kneezel et al.
5,168,284 A 12/1992 Yeung
5,736,995 A 4/1998 Bohorquez et al.
5,917,509 A 6/1999 Beccera et al.
6,302,507 B1 10/2001 Prakash et al.
6,322,189 B1 11/2001 Anderson et al.
7,163,278 B2 1/2007 Lee et al.

FOREIGN PATENT DOCUMENTS

JP 11105289 A * 4/1999 ..... B41J 2/04541

OTHER PUBLICATIONS

IP.com search.*

* cited by examiner

*Primary Examiner* — Lisa M Solomon
(74) *Attorney, Agent, or Firm* — Gary A. Kneezel

(57) ABSTRACT

An inkjet printing system includes a drop ejector array module having a temperature sensor and a logic circuit for sequentially selecting one or more drop ejectors in the array. The system also includes an image data source for providing an image data signal, a memory for storing a temperature correction factor, and a memory for storing at least one drop ejector correction factor. The system includes a fire pulse generator configured to receive signals corresponding to the temperature sensor, the temperature correction factor and the at least one drop ejector correction factor and to output a fire pulse waveform. Also included is a heating pulse generator configured to receive signals corresponding to the temperature sensor and the temperature correction factor and to output a heating pulse waveform. A waveform selector is provided for selecting either a fire pulse waveform or a heating pulse waveform based on the image data signal.

22 Claims, 15 Drawing Sheets

FIG. 1 – PRIOR ART

INKJET PRINTING APPARATUS WITH FIRING OR HEATING WAVEFORM SELECTOR

CROSS-REFERENCE TO RELATED APPLICATION

Reference is made to commonly assigned, co-pending U.S. patent application Ser. No. 15/182,145, entitled: "Inkjet printhead with multiple aligned drop ejectors", by Richard Mu and Yonglin Xie, and co-pending U.S. patent application Ser. No. 15/242,627, entitled: "Inkjet printhead temperature sensing at multiple locations", by Richard Mu and Yonglin Xie, which are incorporated herein by reference.

FIELD OF THE INVENTION

This invention pertains to the field of inkjet printing and more particularly to providing improved image uniformity.

BACKGROUND OF THE INVENTION

Inkjet printing is typically done by either drop-on-demand or continuous inkjet printing. In drop-on-demand inkjet printing ink drops are ejected onto a recording medium using a drop ejector including a pressurization actuator (thermal or piezoelectric, for example). Selective activation of the actuator causes the formation and ejection of a flying ink drop that crosses the space between the printhead and the recording medium and strikes the recording medium. The formation of printed images is achieved by controlling the individual formation of ink drops, as is required to create the desired image.

Motion of the recording medium relative to the printhead during drop ejection can consist of keeping the printhead stationary and advancing the recording medium past the printhead while the drops are ejected, or alternatively keeping the recording medium stationary and moving the printhead. This former architecture is appropriate if the drop ejector array on the printhead can address the entire region of interest across the width of the recording medium. Such printheads are sometimes called pagewidth printheads. A second type of printer architecture is the carriage printer, where the printhead drop ejector array is somewhat smaller than the extent of the region of interest for printing on the recording medium and the printhead is mounted on a carriage. In a carriage printer, the recording medium is advanced a given distance along a medium advance direction and then stopped. While the recording medium is stopped, the printhead carriage is moved in a carriage scan direction that is substantially perpendicular to the medium advance direction as the drops are ejected from the nozzles. After the carriage-mounted printhead has printed a swath of the image while traversing the print medium, the recording medium is advanced; the carriage direction of motion is reversed; and the image is formed swath by swath.

A drop ejector in a drop-on-demand inkjet printhead includes a pressure chamber having an ink inlet for providing ink to the pressure chamber, and a nozzle for jetting drops out of the chamber. Two side-by-side drop ejectors are shown in prior art FIG. 1 (adapted from U.S. Pat. No. 7,163,278) as an example of a conventional thermal inkjet drop-on-demand drop ejector configuration. Partition walls 20 are formed on a base plate 10 and define pressure chambers 22. A nozzle plate 30 is formed on the partition walls 20 and includes nozzles 32, each nozzle 32 being disposed over a corresponding pressure chamber 22. Ink enters pressure chambers 22 by first going through an opening in base plate 10, or around an edge of base plate 10, and then through ink inlets 24, as indicated by the arrows in FIG. 1. A heating element 35, which functions as the actuator, is formed on the surface of the base plate 10 within each pressure chamber 22. Heating element 35 is configured to selectively pressurize the pressure chamber 22 by rapid boiling of a portion of the ink in order to eject drops of ink through the nozzle 32 when an energizing pulse of appropriate amplitude and duration is provided.

Other types of actuators that use resistive heating elements to selectively pressurize the pressure chamber for drop ejection include thermal actuators that have a multilayer cantilevered element that is caused to rapidly bend toward the nozzle when the resistive heating element layer is pulsed. Less heating of the ink is required than for thermal inkjet, where the ink is locally vaporized to provide the ejection pressure.

Uniformity in the volume of the ejected drops of ink in drop-on-demand inkjet printheads is important for providing excellent print quality. If drops are larger or smaller than the nominal value they can cause darker or lighter regions respectively in the printed image, resulting in undesirable banding defects. Drop volume variations can be caused by geometrical variations in the drop ejectors, such as variations in the nozzle diameter. Drop volume variations can also be caused by electrical performance variations, due to variations in heating element resistance R, for example. When a constant voltage V is pulsed across an array of heating elements, heating elements with lower resistance will receive an increased amount of heating power, as the heating power applied to each heating element equals $V^2/R$.

Drop ejectors in drop-on-demand inkjet printheads work well within a given temperature range. Printhead temperature can vary due to variation in ambient temperature as well as to temperature rise associated with the energy dissipated on the printhead during operation. A known problem in drop-on-demand inkjet printing is the degradation in output print quality due to temperature-related changes in the volume of ink that is ejected. One reason why the size of ejected drops increases with temperature of the printhead is that ink viscosity decreases with increased temperature. In addition, for thermal inkjet printheads, the amount of ink that is vaporized by a resistive heating element during a printing pulse increases with increased printhead temperature. Although a significant portion of the heat is carried off by the ejected ink drops, some of the heat remains in the printhead and results in an increased printhead temperature. At sufficiently high temperature the drop ejection can become unreliable, resulting in missing dots in the printed image.

Various printhead temperature control and pulse waveform control systems and methods are known in the prior art for sensing inkjet printhead temperature and using sensed temperature signals to compensate for temperature fluctuations. The approach in printhead temperature control is to keep the printhead within a narrow temperature range by auxiliary heating or cooling for example. In pulse waveform control the approach is to tailor the pulses that are provided to the resistive heating elements in order to compensate for temperature changes on the printhead so that the drop volume remains substantially constant. In both approaches it is important to have an accurate measurement of temperature in the vicinity of the drop ejectors.

U.S. Pat. No. 7,163,278 discloses a thermal inkjet printhead temperature control system that regulates the temperature of a printhead using a temperature sensing device and a heating component. The temperature sensing device includes either a collection of transducers or a single thermistor located on the drop ejector substrate or on a printed circuit board to which the printhead is attached. It is disclosed that at low temperatures, low energy pulses are sent to a nozzle to heat it. These low energy pulses have insufficient energy to cause a drop of ink to be ejected. It is further disclosed that at high temperature, the use profile and the temperature are monitored to see if a particular nozzle exceeds its operable range. If so, printing by that nozzle is stopped until the temperature drops.

As indicated above, drop volume tends to increase with increased temperature of the printhead and ink. It is also known that drop volume can be affected by the pulse waveform. As disclosed in U.S. Pat. No. 4,982,199, ink in the vicinity of the nozzle of a drop ejector can be pre-warmed by pulsing the resistive heating element using one or more pulses that have insufficient energy to form a vapor bubble of ink prior to the firing pulse that forms the vapor bubble. By pre-warming the ink, more of the ink in the nozzle region is brought to the vaporization temperature by the firing pulse before the transfer of heat to the ink from the resistive heating element is interrupted by the formation of the vapor bubble. Vaporizing more of the ink forms a larger bubble, which provides the power for ejecting a larger drop of ink. U.S. Pat. No. 4,982,199 contemplates the use of pre-warming pulses for use in gray-scaling rather than for compensation of drop volume for temperature variation.

U.S. Pat. No. 5,036,337 discloses attaching a temperature sensor to a surface of the drop ejector substrate. The resistive heating elements on the drop ejector substrate are connected to drivers that are not on the drop ejector substrate. Temperature signals from the temperature sensor are sent to a controller, and the controller enables actuation of selected resistive heating elements through the drivers using packets of electrical pulses. A digital clock signal is also provided to the controller. It is disclosed that pulse widths, idle times between pulses or number of pulses per packet can be increased or decreased by one or more clock units to change the pulse waveform in order to control drop volume in response to the temperature measured by the temperature sensor according to a look-up table that provides data to the controller. U.S. Pat. No. 5,917,509 discloses one or more precursor pulses (or warming pulses) that are applied to the resistive heating element for warming the ink nearby, followed by a print pulse that causes a drop of ink to be ejected.

U.S. Pat. No. 5,107,276 discloses a thermal inkjet printer having a printhead that is maintained at a substantially constant operating temperature during printing. Heating elements identified by the printing data for printing are provided with ejecting pulses having sufficient energy to form ink vapor bubbles for ejecting ink drops. To prevent printhead temperature fluctuations during printing, the heating elements not being used to eject droplets are selectively energized with energy pulses having insufficient magnitude to vaporize the ink. In one embodiment a device is provided for determining the logical complement of the printing data, thereby identifying the heating elements not being used to eject droplets. In response to the logical complement input, a sub-threshold pulse width controller can be used to pulse the non-ejecting heating elements with pulses that are too short for ejecting drops, but sufficient to reduce temperature fluctuations on the printhead by providing supplemental heat.

U.S. Pat. No. 5,168,284 discloses a method and apparatus for real-time control of the temperature of thermal inkjet printheads through the use of nonprinting pulses. A closed-loop system includes a closed-loop pulse generator that produces non-printing pulses in response to a difference between a reference temperature signal and a printhead temperature signal produced by a temperature sensor on the printhead. When the printhead temperature exceeds the temperature indicated by the reference temperature signal, the closed-loop system reduces the amount of energy transmitted by the closed-loop non-printing pulses. An open-loop system transmits non-printing pulses to the printhead for each printing interval that the printer does not eject a drop. During each interval, an open-loop pulse generator applies either a printing pulse or one or more nonprinting pulses across a firing resistor. A data interpreter reads print data. If the print data contains a command in a particular printing interval, the data interpreter instructs the open-loop pulse generator to generate a printing pulse. Otherwise the data interpreter instructs the open-loop pulse generator to generate one or more open-loop non-printing pulses. A summing node merges the output of the various pulse generators onto a single trace leading to a firing resistor.

U.S. Pat. No. 5,736,995 discloses a technique for controlling print quality in an inkjet printer by delivering synchronized heating non-printing pulses and printing pulses to the ink firing resistors. A temperature of the printhead substrate is measured and compared against a reference temperature during printing operations. If the measured temperature is below the reference temperature, then the printhead substrate is heated during the printing operations to bring the substrate up to the reference temperature. The heating is done by delivering synchronized heating non-printing pulses and printing pulses to the ink firing resistors during selected print firing periods, such that either the heating pulses or the printing pulses, but not both, occur during a selected print firing period. The heating pulses are logically OR-ed with the printing pulses to achieve the synchronization.

U.S. Pat. No. 6,302,507 discloses an inkjet printhead assembly that includes a data processor, such as a distributive processor having digital circuitry. The data processor formulates firing and timing operations based on sensed information, such as sensed printhead temperature and sensed power supplied, as well as given operating information, such as optimal operating ranges e.g., temperature ranges and energy ranges. The data processor can calculate an adjusted pulse width using a pulse width adjustment factor determined using the sensed temperature along with an equation or look-up table. A printhead memory device included in the printhead assembly can store various printhead specific data including printhead characterization data. A factory calibration process is disclosed for compensating for variations in the printhead assembly, such as variation between ink ejection elements. A turn-on voltage can be determined and used for calculating an operating voltage and nominal pulse width that can be written to the printhead memory. The operating voltage and nominal pulse width calibration data are read from printhead or printer memory.

U.S. Pat. No. 6,322,189 discloses an apparatus and method for controlling temperature fluctuations between printhead dies in a multiple printhead die printer. By reducing temperature variations, changes in image intensity that are attributable to temperature variations are reduced. Temperature control logic is preferably provided in each printhead. By sending a pulse having a reduced duration or reduced current that is insufficient to expel ink, the ink in the printhead can be heated to a desired temperature.

Despite the previous advances in temperature control and drop volume control on inkjet printheads, what is still needed are printing apparatus designs and printing methods that provide drop volume control at high speed for fast throughput printing. If the heating pulse is allowed to overlap with the firing pulse, excessive heating of the resistor can result. To avoid overlap, the summing method disclosed in '284 and the OR-ing method described in '995 referenced above, for example, can require an increase in the firing time interval that results in a reduced printing throughput speed. Additionally still needed are printing apparatus designs and printing methods that enable improved image quality despite changes in drop volume.

SUMMARY OF THE INVENTION

According to an aspect of the present invention, an inkjet printing system includes an image data source for providing an image data signal, a memory for storing at least one drop ejector correction factor, and a memory for storing a temperature correction factor. The system also includes at least one drop ejector array module, where each drop ejector array module includes a substrate and an array of drop ejectors disposed on the substrate. Each drop ejector includes a nozzle, an ink inlet, a pressure chamber in fluidic communication with the nozzle and the ink inlet, and a heating element configured to selectively pressurize the pressure chamber for ejecting ink through the nozzle. Each drop ejector array module also includes a temperature sensor disposed on the substrate, and a logic circuit for sequentially selecting one or more drop ejectors in the drop ejector array. The system further includes a fire pulse generator that is configured to receive signals corresponding to the temperature sensor, the at least one drop ejector correction factor, and the temperature correction factor and is configured to output a fire pulse waveform. Also included in the system is a heating pulse generator that is configured to receive signals corresponding to the temperature sensor and the temperature correction factor and is configured to output a heating pulse waveform. Further included is a waveform selector for selecting either a fire pulse waveform or a heating pulse waveform based on the image data signal. The waveform selector includes a first AND circuit having a first input corresponding to the fire pulse waveform, a second input corresponding to the image data signal, and a first AND circuit output. The waveform selector also includes a second AND circuit having a first input corresponding to the heating pulse waveform, a second input corresponding to an inverted image data signal, and a second AND circuit output. The waveform selector further includes an OR circuit having a first input corresponding to the first AND circuit output, a second input corresponding to the second AND circuit output; and an output waveform that is configured to be sent to the heating element in a drop ejector selected by the logic circuit.

According to another aspect of the present invention, an inkjet printing system includes an image data source for providing an image data signal, a memory for storing at least one drop ejector correction factor, and a memory for storing a temperature correction factor. The system also includes at least one drop ejector array module, where each drop ejector array module includes a substrate and an array of drop ejectors disposed on the substrate. Each drop ejector includes a nozzle, an ink inlet, a pressure chamber in fluidic communication with the nozzle and the ink inlet, and a heating element configured to selectively pressurize the pressure chamber for ejecting ink through the nozzle. Each drop ejector array module also includes a logic circuit for sequentially selecting one or more drop ejectors in the drop ejector array, a temperature sensor disposed on the substrate, and a waveform selector for selecting either a fire pulse waveform or a heating pulse waveform based on the image data signal. The system further includes an image data filtering mask generator configured to generate an image data mask, The image data filtering mask generator includes a first input corresponding to the at least one drop ejector correction factor.

According to still another aspect of the present invention, a method is provided for firing a thermal inkjet drop ejector array module for selectively ejecting drops. The method includes the following steps: a) sending a signal from a temperature sensor on the drop ejector array module to a fire pulse generator and to a heating pulse generator; b) sending a temperature correction factor signal to the fire pulse generator and to the heating pulse generator; c) sending at least one drop ejector correction factor signal to the fire pulse generator; d) generating a fire pulse waveform; e) generating a heating pulse waveform; f) selecting a group of drop ejectors for pulsing corresponding to a first print cycle; g) sending an image data signal to a waveform selector; h) selecting the fire pulse waveform when the image data signal corresponds to a print command; i) selecting the heating pulse waveform when the image data signal corresponds to no print command; j) sending the selected pulse waveform to the thermal inkjet drop ejector array module for pulsing the selected group of drop ejectors; and k) repeating at least steps f) through j) to fire additional groups of drop ejectors during subsequent print cycles.

According to still another aspect of the present invention, a method is provided for firing a thermal inkjet drop ejector array module for selectively ejecting drops. The method includes the following steps: a) sending a signal from a temperature sensor on the drop ejector array module to a fire pulse generator and to a heating pulse generator; b) sending a temperature correction factor signal to the fire pulse generator and to the heating pulse generator; c) sending at least one drop ejector correction factor signal to the fire pulse generator; d) generating a first fire pulse waveform; e) generating a first heating pulse waveform; f) generating at least a second fire pulse waveform; the second fire pulse waveform having the same characteristics as the first fire pulse waveform and delayed by a offset time relative to the first fire pulse waveform; g) generating at least a second heating pulse waveform; the second heating pulse waveform having the same characteristics as the first heating pulse waveform and delayed by a offset time relative to the first heating pulse waveform; h) selecting a first group of drop ejectors corresponding to a first firing phase; i) sending an image data signal to a waveform selector; j) selecting the first fire pulse waveform when the image data signal corresponds to a print command; k) selecting the first heating pulse waveform when the image data signal corresponds to no print command; l) sending the selected pulse waveform to the thermal inkjet drop ejector array module for pulsing the first group of drop ejectors; m) selecting a second group of drop ejectors corresponding to at least a second firing phase; n) sending an image data signal to the waveform selector; o) selecting the second fire pulse waveform when the image data signal corresponds to a print command; p) selecting the second heating pulse waveform when the image data signal corresponds to no print command; q) sending the selected pulse waveform to the thermal inkjet drop ejector array module for pulsing the second group of drop ejectors; and r) repeating at least steps m) through q) to fire additional groups of drop ejectors.

This invention has the advantage that a nominal image density printed by an inkjet printing system is kept more uniform. It has the additional advantage of fast printing throughput.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

Figure 2:
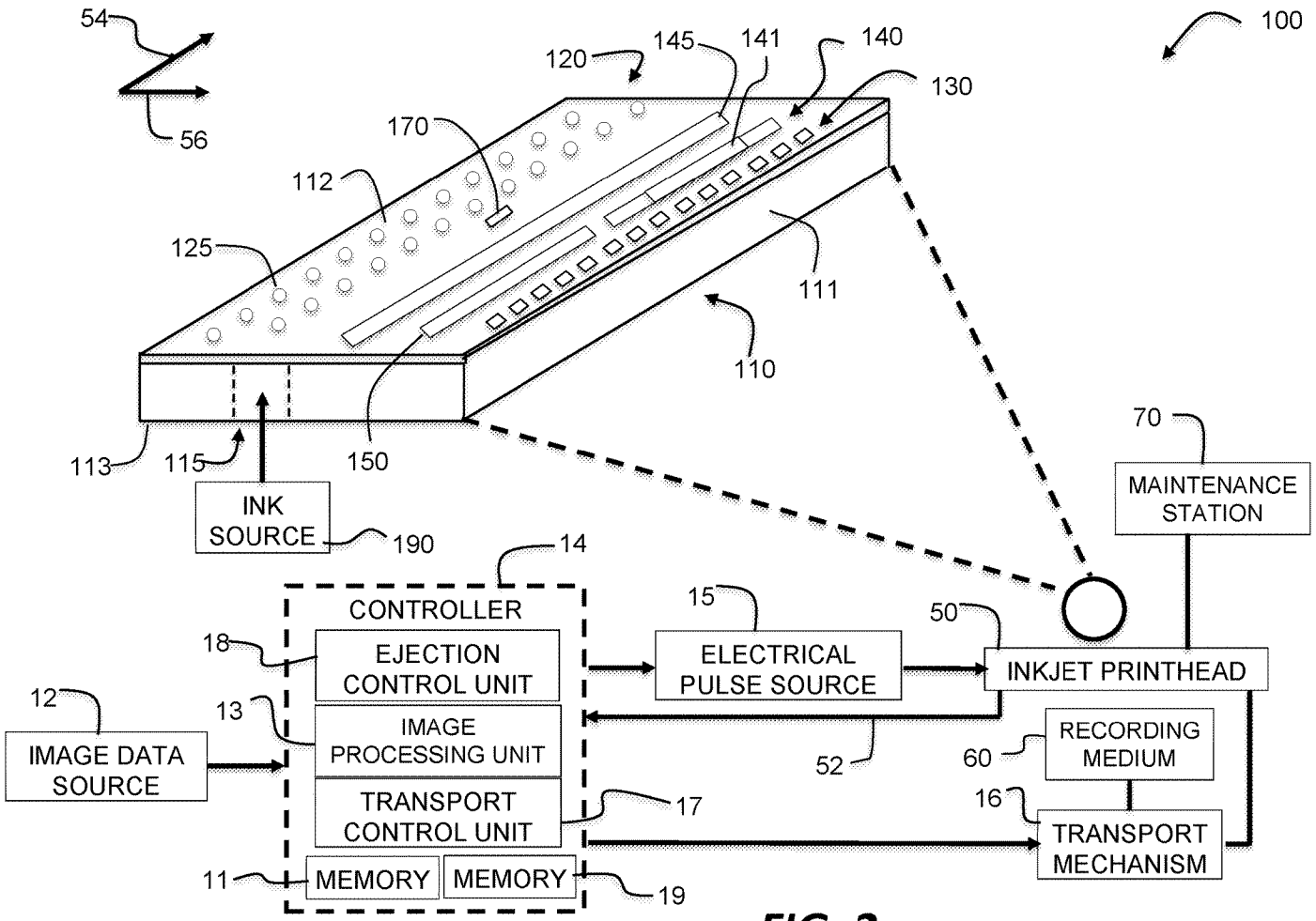
FIG. 2 is a schematic representation of an inkjet printing system according to an embodiment.

FIG. 2 shows a schematic representation of an inkjet printing system 100 together with a perspective of drop ejector array module 110, according to an embodiment of the present invention. Drop ejector array module 110 can also be called a printhead die. Image data source 12 provides image data signals that are interpreted by a controller 14 as commands for ejecting drops. Controller 14 includes an image processing unit 13 for rendering images for printing. The term "image" is meant herein to include any pattern of dots directed by the image data. It can include graphic or text images. It can also include patterns of dots for printing functional devices if appropriate inks are used. Controller 14 also includes a transport control unit 17 for controlling transport mechanism 16 and an ejection control unit 18 for ejecting ink drops to print a pattern of dots corresponding to the image data on the recording medium 60. Controller 14 sends output signals to an electrical pulse source 15 for sending electrical pulse waveforms to an inkjet printhead 50 that includes at least one drop ejector array module 110. A printhead output line 52 is provided for sending electrical signals from the printhead 50 to the controller 14 or to sections of the controller 14, such as the ejection control unit 18. For example, printhead output line 52 can carry a temperature measurement signal from printhead 50 to controller 14. Transport mechanism 16 provides relative motion between inkjet printhead 50 and recording medium 60 along a scan direction 56. Transport mechanism 16 is configured to move the recording medium 60 along scan direction 56 while the printhead 50 is stationary in some embodiments. Alternatively, transport mechanism 16 can move the printhead 50, for example on a carriage, past stationary recording medium 60. Various types of recording media for inkjet printing include paper, plastic, and textiles. In a 3D inkjet printer, the recording media include flat building platform and thin layer of powder material. In addition, in various embodiments recording medium 60 can be web fed from a roll or sheet fed from an input tray.

Figure 1:
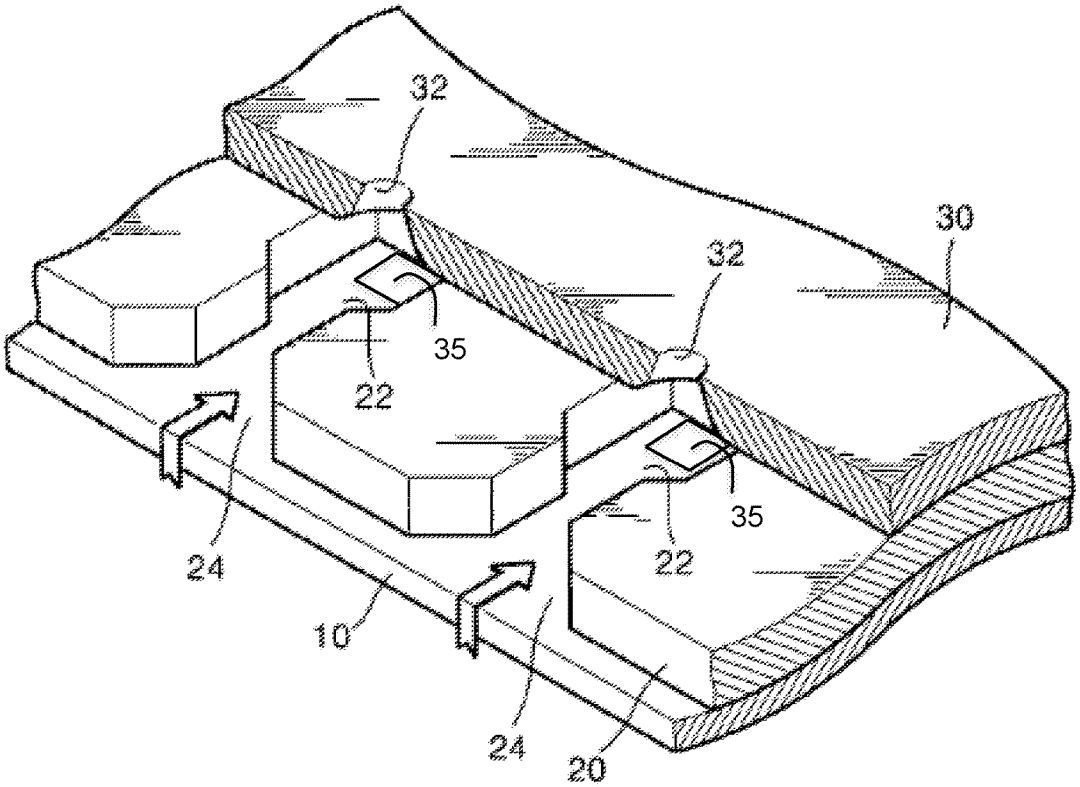
FIG. 1 shows a perspective of a prior art drop ejector configuration.

Drop ejector array module 110 includes at least one drop ejector array 120 including a plurality of drop ejectors 125 formed on a top surface 112 of a substrate 111 that can be made of silicon or other appropriate material. In the example shown in FIG. 2, drop ejector array 120 includes a pair of rows of drop ejectors 125 that extend along array direction 54 and that are staggered with respect to each other in order to provide increased printing resolution. Ink is provided to drop ejectors 125 by ink source 190 through ink feed 115 which extends from the back surface 113 of substrate 111 toward the top surface 112. Ink source 190 is generically understood herein to include any substance that can be ejected from an inkjet printhead drop ejector. Ink source 190 can include colored ink such as cyan, magenta, yellow or black. Alternatively ink source 190 can include conductive material, dielectric material, magnetic material, or semiconductor material for functional printing. Ink source 190 can alternatively include biological or other materials. For simplicity, location of the drop ejectors 125 is represented by the circular nozzle. Not shown in FIG. 2 are the pressure chamber 22, the ink inlet 24, or the actuator 35 (FIG. 1). Ink inlet 24 is configured to be in fluidic communication with ink source 190. The pressure chamber 22 is in fluidic communication with the nozzle 32 (FIG. 1) and the ink inlet 24. The actuator 35, e.g. a heating element, is configured to selectively pressurize the pressure chamber 22 for ejecting ink through the nozzle 32. Drop ejector array module 110 includes a group of input/output pads 130 for sending signals to and sending signals from drop ejector array module 110 respectively. Also provided on drop ejector array module 110 are logic circuitry 140 and driver circuitry 145. Logic circuitry 140 processes signals from controller 14 and electrical pulse source 15 and provides appropriate pulse waveforms at the proper times to driver circuitry 145 for actuating the drop ejectors 125 of drop ejector array 120 in order to print an image corresponding to data from image processing unit 13. Logic circuitry 140 includes a logic circuit 141 for sequentially selecting one or more drop ejectors in the drop ejector array to be actuated. Groups of drop ejectors 125 in the drop ejector array are fired sequentially so that the capacities of the electrical pulse source 15 and the associated power leads are not exceeded. A group of drop ejectors 125 is fired during a print cycle. A stroke is defined as a plurality of sequential print cycles, such that during a stroke all of the drop ejectors 125 of drop ejector array 120 are fired once. Logic circuit 141 can include circuit elements such as shift registers, gates and latches that are associated with inputs for functions including providing data, timing, and resets. In addition, drop ejector array module 110 includes at least one temperature sensor 170 disposed on substrate 111 near drop ejectors 125.

Inkjet printing system 100 also includes a memory 11 for storing at least one drop ejector correction factor, and a memory 19 for storing a temperature correction factor. Memories 11 and 19 are shown as part of controller 14 in the example shown in FIG. 2. The at least one drop ejector correction factor stored in memory 11 can include data corresponding to geometrical variations in drop ejectors, such as data corresponding to a nozzle diameter. The at least one drop ejector correction factor can include data corresponding to electrical performance, such as data corresponding to a heating element resistance or data corresponding to an activation energy for ejecting drops from the drop ejectors in the drop ejector array module. The at least one drop correction factor stored in memory 11 and the temperature correction factor stored in memory 19 can be used by controller 14 to modify characteristics of signals sent to electrical pulse source 15 for providing electrical pulse waveforms to drop ejector array module 110 that are tailored to improve drop volume uniformity. For example, a nozzle having a diameter that is larger than nominal will tend to eject larger drops than a nozzle having a diameter that is smaller than nominal. A drop correction factor for a drop ejector 125 having a larger than nominal nozzle can be used by the ejection control unit 18 of controller 14 to pulse the corresponding drop ejector 125 with a lower than nominal energy electrical pulse waveform so that the tendency of the large-nozzle drop ejector to eject a larger than nominal drop volume is compensated for. A lower energy electrical pulse waveform can have a reduced pulse width or a reduced number of pulses for example. A drop correction factor for a drop ejector 125 having a higher than nominal heating element resistance can be used by the ejection control unit 18 of controller 14 to pulse the corresponding drop ejector 125 with an electrical pulse waveform having an increased pulse width or an increased number of pulses, for example, in order to compensate for the decreased $V^2/R$ heating power that is associated with a larger resistance R at a constant voltage V across the drop ejectors 125. A drop correction factor for a drop ejector 125 requiring a higher than nominal activation energy for ejecting drops can be used by the ejection control unit 18 of controller 14 to pulse the corresponding drop ejector 125 with an electrical pulse waveform having an increased pulse width or an increased number of pulses, for example, in order to provide the increased activation energy for ejecting drops.

Maintenance station 70 keeps the drop ejectors 125 of drop ejector array module 110 on printhead 50 in proper condition for reliable printing. Maintenance can include operations such as wiping the top surface 112 of drop ejector array module 110 in order to remove excess ink, or applying suction to the drop ejector array 120 in order to prime the nozzles. Maintenance operations can also include spitting, i.e. the firing of non-printing ink drops into a reservoir in order to provide fresh ink to the pressure chambers and the nozzles, especially if the drop ejectors have not been fired recently. Volatile components of the ink can evaporate through the nozzle over a period of time and the resulting increased viscosity can make jetting unreliable.

Figure 3:
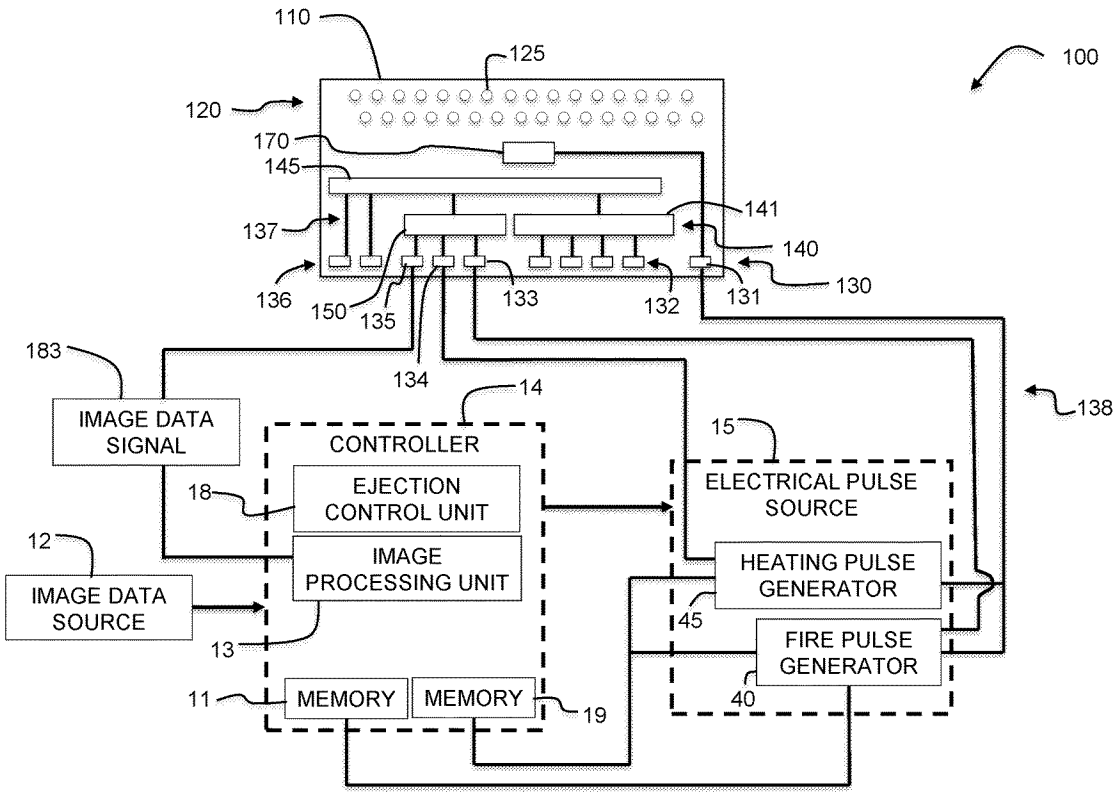
FIG. 3 shows a schematic representation of a portion of the inkjet printing system in greater detail together with a top view of a drop ejector array module.

FIG. 3 shows a schematic representation of a portion of inkjet printing system 100 in greater detail. Electrical pulse source 15 includes a fire pulse generator 40 for providing electrical pulse waveforms to eject ink drops and a heating pulse generator 45 for providing heating pulses for temperature control. Inkjet printing system 100 also includes a waveform selector 150 for selecting either a fire pulse waveform or a heating pulse waveform based on the image data signal. In a preferred embodiment, shown in FIGS. 2 and 3, waveform selector 150 is integrated as part of the logic circuitry 140 of drop ejector array module 110.

FIG. 3 also shows a number of electrical interconnections in inkjet printing system 100. Electrical traces 137 on drop ejector array module 110 connect various components of the device and also provide electrical connection to input/output pads 130. For simplicity, not all of the electrical traces 137 are shown. For example, none of the electrical connections between driver circuitry 145 and the individual drop ejectors 125 are shown. An electrical trace 137 connects temperature sensor 170 with temperature output pad 131. A set of electrical traces 137 connect logic circuit 141 to a set of logic circuit input/output pads 132 that can include contacts for logic ground, logic voltage, and clock, for example. A set of electrical traces 137 connect waveform selector 150 with fire pulse input pad 133, heating pulse input pad 134 and image data input pad 135. Image data input pad 135 is also connected to logic circuit 141 by an electrical trace 137 that is not shown for simplicity. Electrical traces 137 connect driver circuitry 145 with driver circuitry input pads 136 that include contacts for fire pulse voltage V and ground, for example. Electrical traces 137 also connect logic circuit 141 and waveform selector 150 with driver circuitry 145.

Electrical leads 138 connect the various input/output pads 130 on drop ejector array module 110 with corresponding subsystems of inkjet printing system 100, and also connect the various subsystems as needed. As shown schematically in FIG. 3, an electrical lead 138 connects temperature output pad 131 to fire pulse generator 40 and heating pulse generator 45. It is understood herein that connections between drop ejector array module 110 and the other parts of inkjet printing system 100 can be made directly between the drop ejector array module 110 and the corresponding subsystem, or they can be made indirectly through controller 14. For example, when it is said herein that the fire pulse generator 40 is configured to receive a signal corresponding to the temperature sensor 170, it is meant to include a direct connection between temperature output pad 131 and fire pulse generator 40. It is also meant to include connection from temperature output pad 131 to ejection control unit 18 in controller 14, and connection from controller 14 to fire pulse generator 40 in electrical pulse source 15. An electrical lead 138 connects fire pulse generator 40 with fire pulse input pad 133 for providing a fire pulse waveform that is output from fire pulse generator 40. An electrical lead 138 connects heating pulse generator 45 with heading pulse input pad 134 for providing a heating pulse waveform that is output from heating pulse generator 45. An electrical lead 138 connects image processing unit 13 in controller 14 with image data input pad 135. An electrical lead 138 connects memory 11 in controller 14 to fire pulse generator 40 for providing signals corresponding to the at least one drop ejector correction factor. An electrical lead 138 connects memory 19 in controller 14 to fire pulse generator 40 and heating pulse generator 45 for providing signals corresponding to the temperature correction factor.

Figure 4:
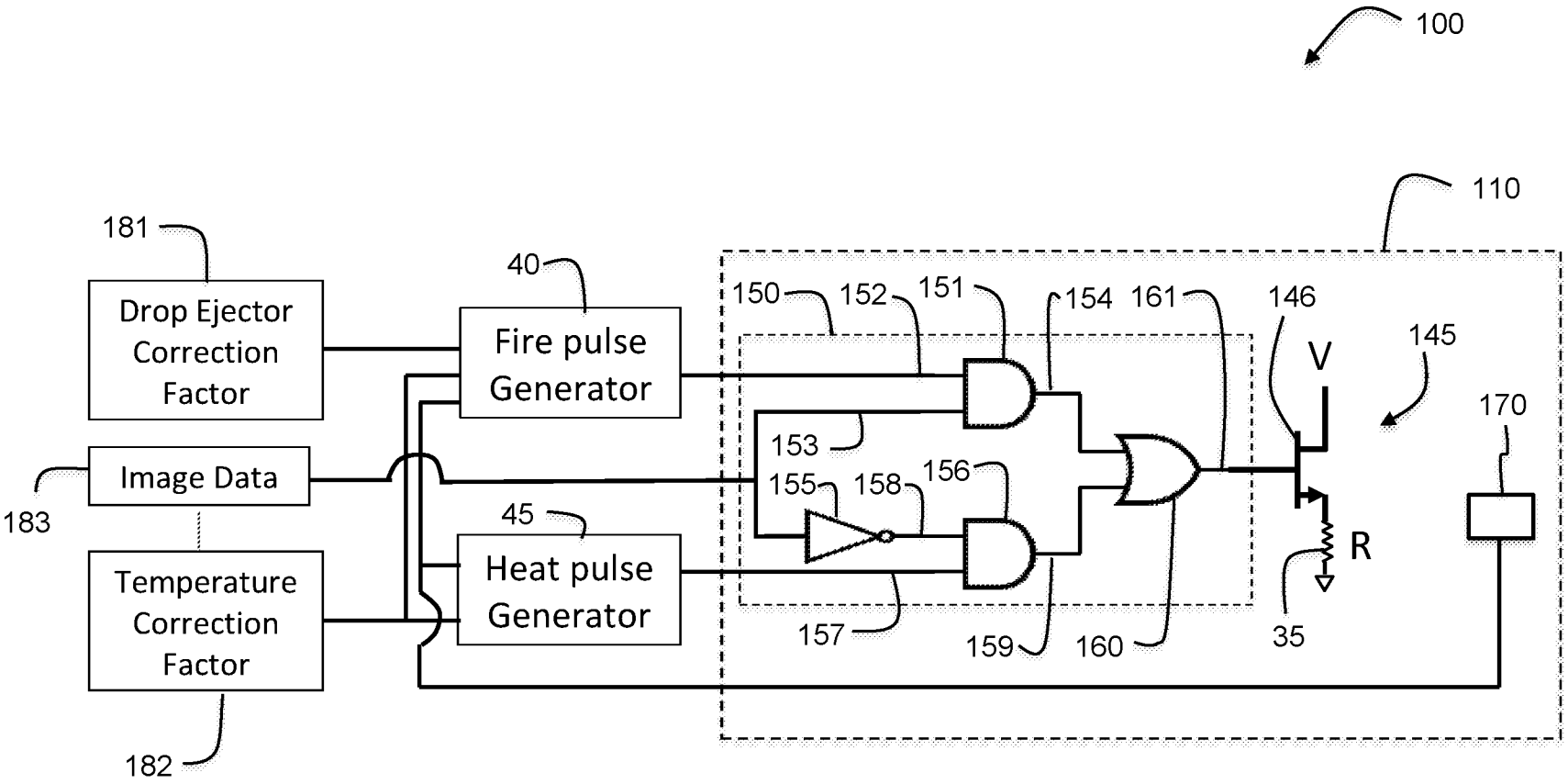
FIG. 4 shows a schematic of a portion of the inkjet printing system including further details of electrical circuitry used in an embodiment of a waveform selector.

FIG. 4 shows a schematic of a portion of inkjet printing system 100 including further details of electrical circuitry used in an embodiment of waveform selector 150. In the example of FIG. 4, a particular heating element 35 is shown, corresponding to a drop ejector that has been selected by the logic circuit 141 (FIG. 3) for printing during a particular print cycle, together with its associated drive transistor 146 that is part of the driver circuitry 145 on drop ejector array module 110. Also included in the drop ejector array module 110 is temperature sensor 170 and waveform selector 150. Waveform selector 150 is provided for selecting either a fire pulse waveform from fire pulse generator 40 or a heating pulse waveform from heating pulse generator 45 based on an image data signal 183 that is sent for the particular print cycle. Image data signal 183 can be provided directly by image data source 12 (FIG. 2) or it can be provided indirectly from image data source 12 via image processing unit 13 of controller 14. The phrase "an image data source for providing an image data signal" is understood herein to mean that the image data signal 183 is provided either directly from image data source 12 or by image processing unit 13. The image data signal 183 indicates whether or not a drop is to be ejected during the particular print cycle from a given drop ejector that has been selected by logic circuit 141.

Fire pulse generator 40 is configured to receive signals corresponding to the temperature sensor 170, the at least one drop ejector correction factor 181, and the temperature correction factor 182 and is configured to output a fire pulse waveform having pulse widths or numbers of pulses, for example, that are modified according to the signals corresponding to the temperature sensor 170, the at least one drop ejector correction factor 181, and the temperature correction factor 182. As described above, the modification of the fire pulse waveform can be performed in the ejection control unit 18 of controller 14.

Heating pulse generator 45 is configured to receive signals corresponding to the temperature sensor 170 and the temperature correction factor 182 and is configured to output a heating pulse waveform having pulse widths or numbers of pulses, for example that are modified according to the signals corresponding to the temperature sensor 170 and the temperature correction factor 182. As described above, the modification of the heating pulse waveform can be performed in the ejection control unit 18 of controller 14.

In the embodiment shown in FIG. 4, waveform selector 150 includes a first AND circuit 151 (for example, a first AND gate), a second AND circuit 156 (for example, a second AND gate), an inverter 155, and an OR circuit 160 (for example, an OR gate). First AND circuit 151 includes a first input 152 corresponding the fire pulse waveform from fire pulse generator 40, a second input 153 corresponding to image data signal 183, and a first AND circuit output 154. If the image data signal 183 is high (i.e. if the image data signal 183 indicates that the drop ejector corresponding to heating element 35 should eject a drop), then the first AND circuit output 154 will be the fire pulse waveform from fire pulse generator 40. If the image data signal 183 is low (i.e. if the image data signal 183 indicates that the drop ejector corresponding to heating element 35 should not eject a drop), then the first AND circuit output will be low. Second AND circuit 156 includes a first input 157 corresponding to the heating pulse waveform from heating pulse generator 45. Inverter 155 inverts the image data signal 183 so that the second input 158 of second AND circuit 156 corresponds to an inverted image data signal. If the image data signal 183 is high (i.e. if the image data signal 183 indicates that the drop ejector corresponding to heating element 35 should eject a drop), then the second AND circuit output 159 will be low. If the image data signal 183 is low (i.e. if the image data signal 183 indicates that the drop ejector corresponding to heating element 35 should not eject a drop), then the second AND circuit output 159 will be the heating pulse waveform from heating pulse generator 45. OR circuit 160 has a first input corresponding to the first AND circuit output 154, and a second input corresponding to the second AND circuit output 159. If the image data signal 183 is high (i.e. if the image data signal 183 indicates that the drop ejector corresponding to heating element 35 should eject a drop), then the output waveform at OR circuit output 161 will be the fire pulse waveform from fire pulse generator 40. If the image data signal 183 is low (i.e. if the image data signal 183 indicates that the drop ejector corresponding to heating element 35 should not eject a drop), then the output waveform at OR circuit output 161 will be the heating pulse waveform from the heating pulse generator 45. The output waveform at OR circuit output 161 is configured to be sent to the heating element 35 in the drop ejector that has been selected by the logic circuit 141 for the particular print cycle. In the example shown in FIG. 4, heating element 35 is connected between ground and the source of drive transistor 146. Fire pulse voltage V is connected to the drain of drive transistor 146. The output waveform from OR circuit 160 at OR circuit output 161 is connected to the gate of drive transistor 146. The selected waveform from waveform selector 150 is the output waveform at OR circuit 161. If the image data signal 183 is high (indicating a print command for the drop ejector associated with heating element 35), then the waveform selector 150 selects the fire pulse waveform from fire pulse generator 40. If the image data signal 183 is low (indicating a no print command for the drop ejector associated with heating element 35), then the waveform selector 150 selects the heating pulse waveform from heating pulse generator 45. Selected fire pulse waveforms or heating pulse waveforms that are sent to pulse the heating elements 35 are called a pulse train. In other words, the pulse train is provided at OR circuit output 161 and corresponds to the shape of either the fire pulse waveform or the heating pulse waveform, depending upon the image data signal 183 during a particular print cycle.

Figure 5:
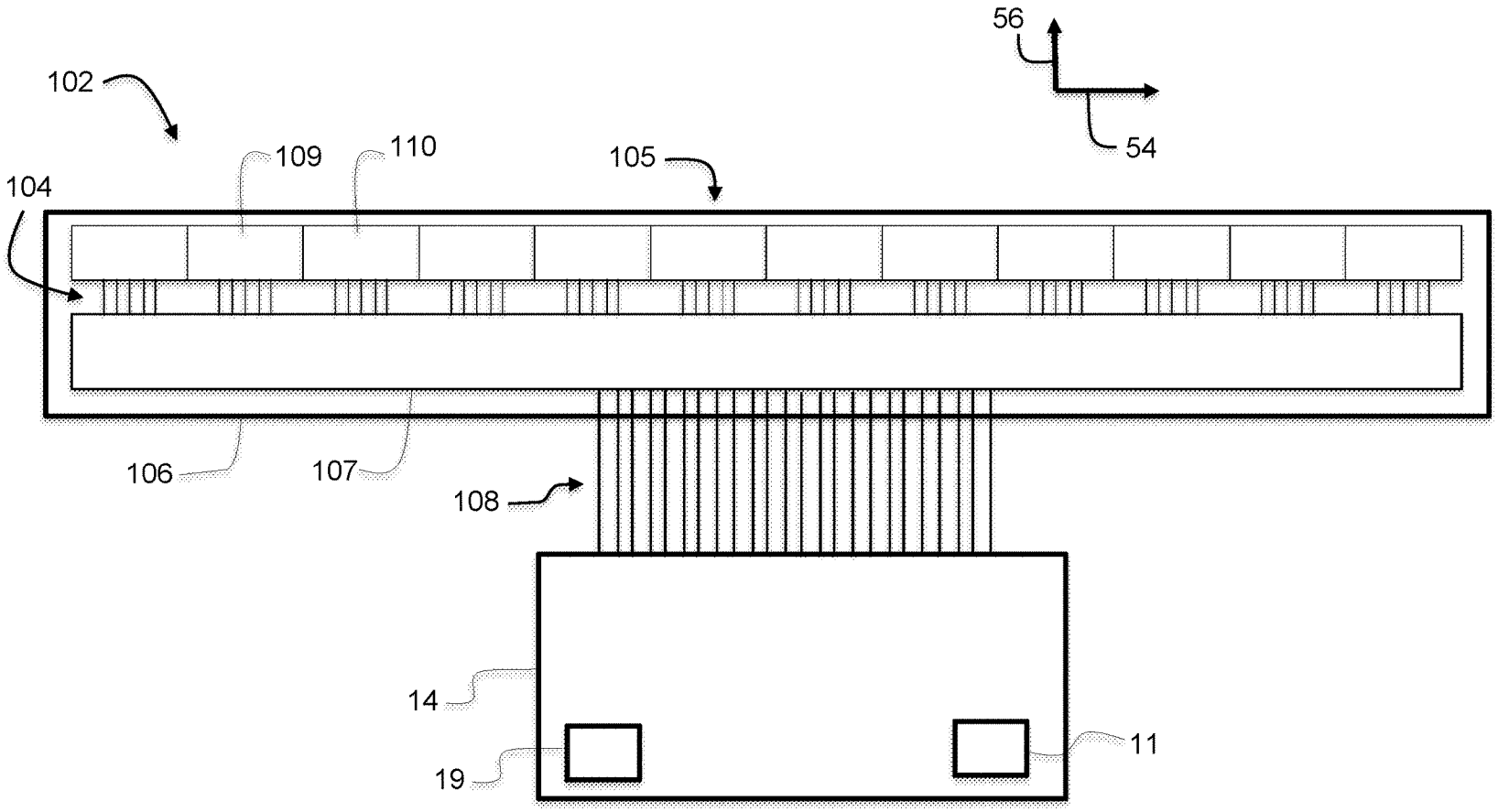
FIG. 5 shows a schematic of a portion of an inkjet printing system having a pagewidth printhead with a plurality of drop ejector array modules.

As indicated above, drop volume control and printing methods that enable improved image quality despite changes in drop volume are important even for inkjet printing systems 100 having only a single drop ejector array module 110. Printing systems having a plurality of drop ejector array modules 110 can provide increased challenges for providing uniform image density for different drop ejector array modules. FIG. 5 shows a schematic of a portion of an inkjet printing system 102 having a pagewidth printhead 105 including a plurality of drop ejector array modules 109 and 110 that are arranged end to end along array direction 54 and affixed to mounting substrate 106. An interconnection board 107 is mounted on mounting substrate 106 and is connected to each of the drop ejector array modules 109 or 110 by interconnects 104 that can be wire bonds or tape automated bonding leads for example. A printhead cable 108 connects the interconnection board 107 to the controller 14. Some of the leads, such as the ground lead(s) in printhead cable 108 are common to all of the drop ejector array modules 109 and 110. Other leads, such as print data input, electrical pulse waveform inputs and temperature output are provided separately to each drop ejector array module 109 and 110. Recording medium 60 (FIG. 2) is moved along scan direction 56 by transport mechanism 16 (FIG. 2) for printing. Controller 14 controls the various functions of the inkjet printing system as described above with reference to FIG. 2. For simplicity, memory 11 for storing at least one drop ejector correction factor for each drop ejector array module 109 and 110, and memory 19 for storing a temperature correction factor for each drop ejector array module 109 and 110 are shown as part of controller 14, but the other various subsections of controller 14 are not shown in FIG. 5.

Providing at least one drop ejector correction factor 181 (FIG. 4) and a temperature correction factor 182 (FIG. 4) for each drop ejector array module 110 can be important for uniform image density across the pagewidth printhead 105. Drop ejector array modules 110 are typically fabricated on silicon wafers that can have a diameter of 150 mm or greater. Wafers having a diameter less than about 250 mm are not large enough to provide drop ejector array modules 110 that are larger than the width of a letter-sized page. Even for 300 mm diameter wafers that are large enough to provide drop ejector array modules 110 that are larger than the width of a page, it is typically more cost effective (due to yield and optimizing the usable area on the wafer) to assemble a pagewidth printhead using drop ejector array modules 110 having a length along the array direction 54 of around 1 to 2 cm. Due to typical manufacturing variability, devices that are fabricated near each other on the same wafer are generally substantially uniform, but devices that are fabricated on more distant locations on the wafer are less uniform. Even less uniform are devices that are fabricated on different wafers in the same batch, and even less uniform are devices that are fabricated at different times on wafers from different batches. As a result, drop ejector correction factors 181 can be substantially different for different drop ejector array modules 110 in pagewidth printhead 105 due to different characteristic nozzle diameters, different characteristic heating element resistances, and different characteristic activation energies. Similarly, temperature correction factors 182 can also be different for different drop ejector array modules 110.

Figure 6:
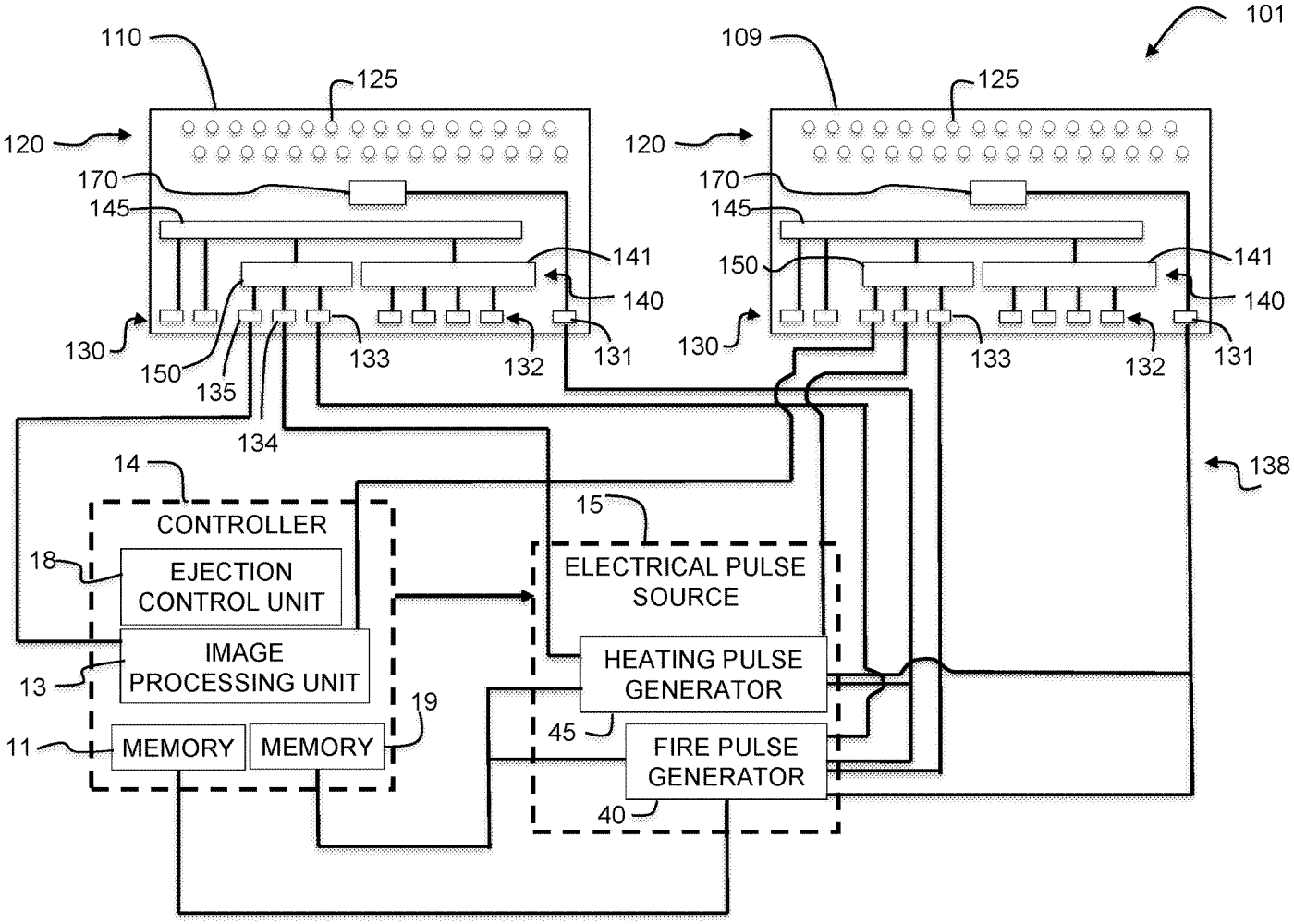
FIG. 6 is similar to FIG. 3 for an embodiment having a plurality of drop ejector array modules.

FIG. 6 shows a schematic of a portion of an inkjet printing system 101 having at least two drop ejector array modules 109 and 110. Inkjet printing system 101 can correspond to the inkjet printing system 102 having a pagewidth printhead 105 as in FIG. 5, or it can correspond to a color inkjet printing system where drop ejector array module 109 is configured to eject one type of ink and drop ejector array module 110 is configured to eject another type of ink. The components of drop ejector array modules 109 and 110 are the same as in FIG. 3, although for simplicity not all of the input/output pads 130 are labeled in FIG. 6. Although drop ejector modules 109 and 110 can be butted end to end as in FIG. 5, they are shown as separated in FIG. 6 in order to show electrical connections more clearly. Electrical leads 138 are provided for connecting drop ejector array modules 109 and 110 in similar fashion to the corresponding subsystems of inkjet printing system 101. As shown schematically in FIG. 6, electrical leads 138 connect temperature output pads 131 of drop ejector array modules 109 and 110 to fire pulse generator 40 and heating pulse generator 45. Electrical leads 138 connect fire pulse generator 40 with fire pulse input pads 133 of drop ejector array modules 109 and 110 for providing fire pulse waveforms that are output from fire pulse generator 40. Electrical leads 138 connect heating pulse generator 45 with heating pulse input pads 134 of drop ejector array modules 109 and 110 for providing heating pulse waveforms that are output from heating pulse generator 45. Electrical leads 138 connect image processing unit 13 in controller 14 with image data input pads 135 of drop ejector array modules 109 and 110. An electrical lead 138 connects memory 11 in controller 14 to fire pulse generator 40 for sequentially providing separate signals corresponding to the at least one drop ejector correction factor for each of drop ejector array modules 109 and 110. Similarly, an electrical lead 138 connects memory 19 in controller 14 to fire pulse generator 40 and heating pulse generator 45 for sequentially providing separate signals corresponding to the temperature correction factor for each of drop ejector array modules 109 and 110. In other words, fire pulse generator 40 is configured for each of the drop ejector array modules 109 and 110 to receive signals corresponding to the temperature sensor 170, the at least one drop ejector correction factor 181 (FIG. 4), and the temperature correction factor 182 (FIG. 4) for each of the drop ejector array modules 109 and 110 and to output a fire pulse waveform to each of the corresponding drop ejector array modules 109 and 110. In addition, the heating pulse generator 45 is configured for each of the drop ejector array modules 109 and 110 to receive signals corresponding to the temperature sensor 170 and the temperature correction factor 182 for each of the drop ejector array modules 109 and 110 and to output a heating pulse waveform to each of the corresponding drop ejector array modules 109 and 110.

Image processing unit 13 typically performs various halftoning and dithering algorithms to simulate continuous tone imagery through the use of printed dots that vary in size or spacing. A halftone cell includes groups of pixels that can be on or off. The local printed image density corresponding to a given halftone cell depends largely on the fraction of the cell area that is covered by ink. The desired dot pattern in a halftone cell is determined by how much ink is required for the corresponding region of the image, as well as the dot arrangements in nearby halftone cells so that repetitive patterns that can cause undesirable artifacts in the image can be avoided. Uniformity in image density for a given image density requirement can be achieved if the fraction of ink coverage is substantially constant for a given halftone cell or group of halftone cells. In some embodiments the purpose of the shaping of the fire pulse waveform and the heating pulse waveform is intended to produce uniformly sized dots from a single drop ejector array module 110 or from a group of drop ejector array modules 110 despite manufacturing variations in the drop ejectors 125 and despite variation in operating conditions such as temperature.

Figure 7A:
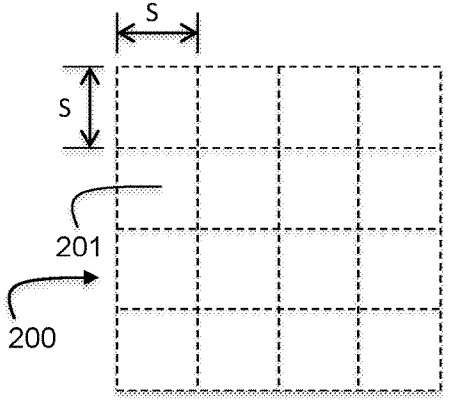
FIG. 7A shows a 4×4 halftone grid.
Figure 7B:
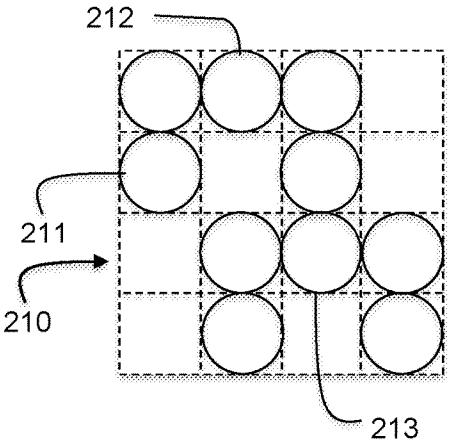
FIGS. 7B-7D show examples of partially filled halftone grids.
Figure 7C:
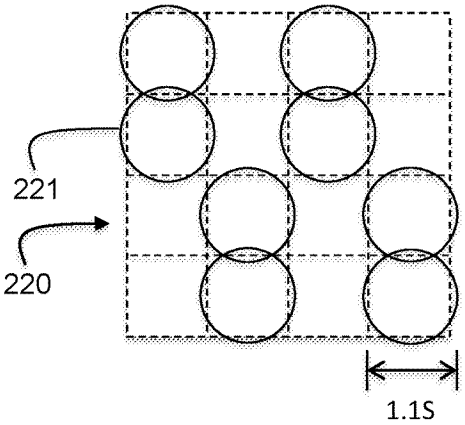

In other embodiments the amount of ink coverage corresponding to a given halftone cell can be modified by increasing or decreasing the number of pixels that are printed for that halftone cell. Increasing or decreasing the number of printed pixels can be particularly advantageous if the manufacturing or temperature variations are so large that the drop volume cannot be kept sufficiently uniform through modifications to the fire pulse waveform and the heating pulse waveform. FIG. 7A shows an example of a 4×4 halftone grid 200 where the sixteen allowable pixel locations 201 are located at the centers of the grid squares, each square having a side length S. Errors in directionality of the ejected drops can cause them to land in locations that are offset from the ideal locations but typically that does not have a large effect on image density. FIG. 7B shows an example of a partially filled halftone grid 210 having ten printed dots 211 with a diameter S. (It is understood that printed dots having a diameter S will not completely fill the space in a grid of squares having side S, even if all dots are printed. However, the example shown in FIGS. 7B and 7C is simply meant to illustrate the method of changing the number of dots in a halftone cell to compensate for different dot diameters that result from different drop volumes.) FIG. 7C shows an example of a partially filled halftone grid 220 having eight printed dots 221 each with a diameter 1.1 S. Because the diameter of each dot 221 in FIG. 7C is 10% larger than the diameter of each dot 211 in FIG. 7B, the area covered by each dot 221 is about 20% greater than the area covered by each dot 211. In order to provide approximately the same printed area coverage in FIG. 7C as in FIG. 7B, two of the ten dots (dots 212 and 213) of FIG. 7B have been removed in the dot pattern shown in FIG. 7C. Although the dot pattern of FIG. 7C has 20% fewer dots than the dot pattern of FIG. 7B, each dot has about 20% larger area, so that the total area coverage within partially filled halftone grids 210 and 220 is substantially the same.

Figure 7D:
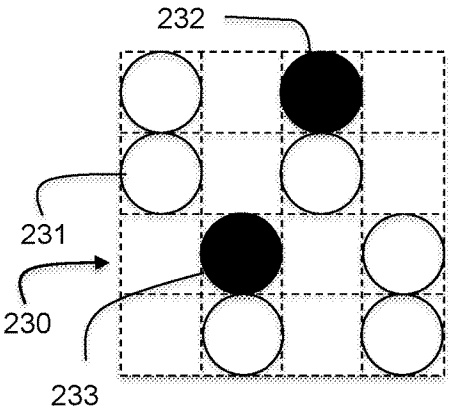

In FIGS. 7B and 7C there is either zero or one printed dot 211 and 221 at each allowable pixel location. Some printers have the capability of depositing multiple drops of ink at each allowable pixel location. In FIG. 7D the unfilled circles represent one drop per pixel location, while filled circles 232 and 233 represent two drops per pixel location. Partially filled grid 230 in FIG. 7D has the same dot layout as partially filled grid 220 in FIG. 7C. Even though the diameters of dots 231 are smaller in FIG. 7D compared to the diameters of dots 221 in FIG. 7C, substantially the same amount of ink is contained in partially filled grids 220 and 230. Dots 232 and 233 having two drops per pixel will typically spread somewhat and have a larger diameter, but that is not shown in FIG. 7D.

Figure 8:
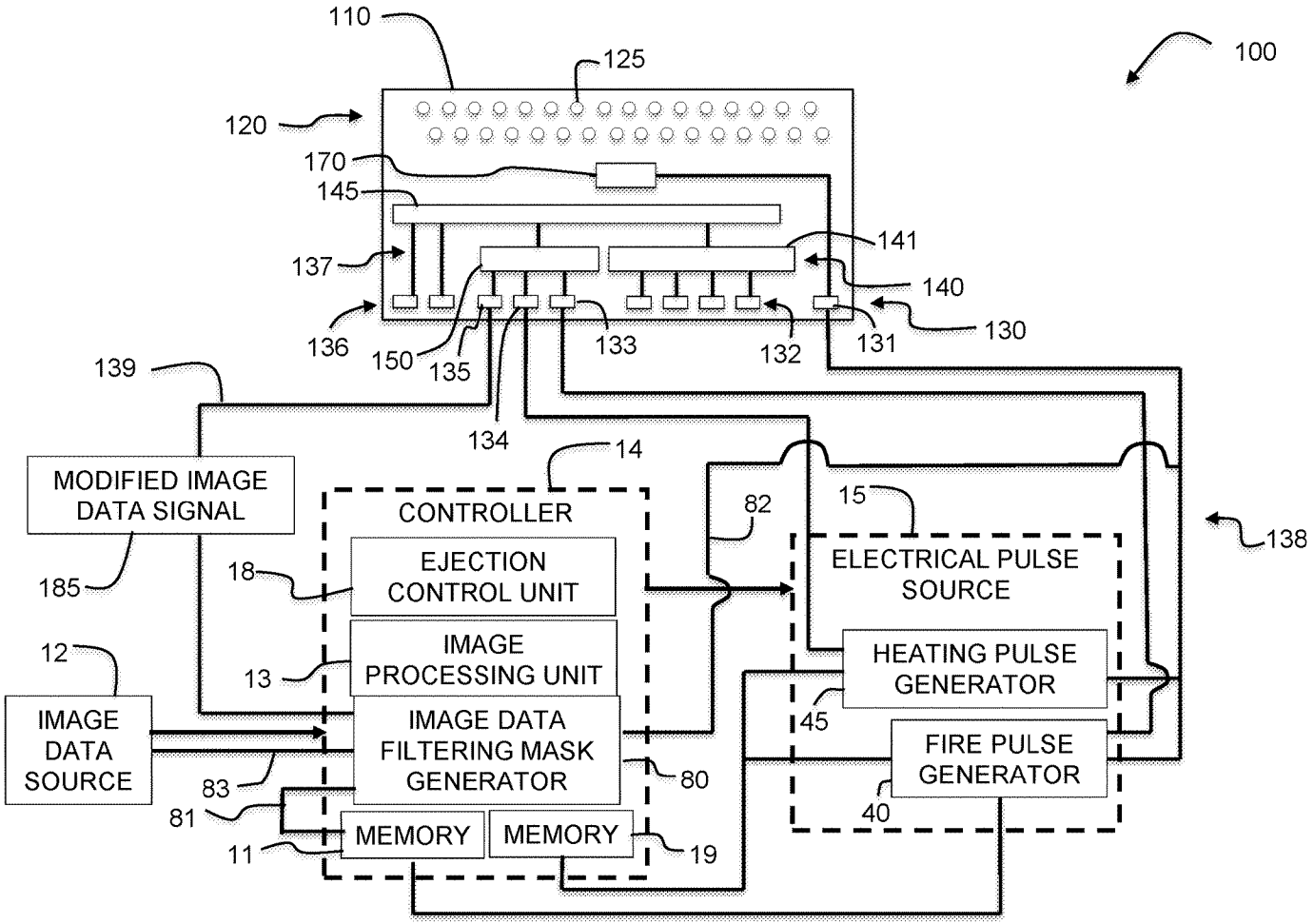
FIG. 8 is similar to FIG. 3 and further includes an image data filtering mask generator.

FIG. 8 shows an embodiment where inkjet printing system 100 further includes an image data filtering mask generator 80 in controller 14. Image data filtering mask generator 80 is configured to generate an image data mask and includes an input 83 for receiving an image data signal from the image data source 12. When it is said herein that image data filtering mask generator 80 is configured to receive the image data signal from the image data source 12, it is understood to mean that either image data filtering mask generator 80 has an input 83 that is directly connected to image data source 12, or image data filtering mask generator 80 has an input that is connected to image processing unit 13. The halftoning and dithering algorithms of image processing unit 13 determine the nominal dot patterns in the various halftone cells that make up the image to be printed. Image data filtering mask generator 80 selectively adds or removes image data bits according to the image data mask in order to provide a more uniform image density when the printed dots are larger or smaller than nominal. Rows of the image data mask extend along array direction 54 and columns of the image data mask extend along scan direction 56. In other words entries in the same row correspond to dots that are printed by different drop ejectors 125, while entries in the same column correspond to dots that can be sequentially printed by a single drop ejector.

Figure 9C:
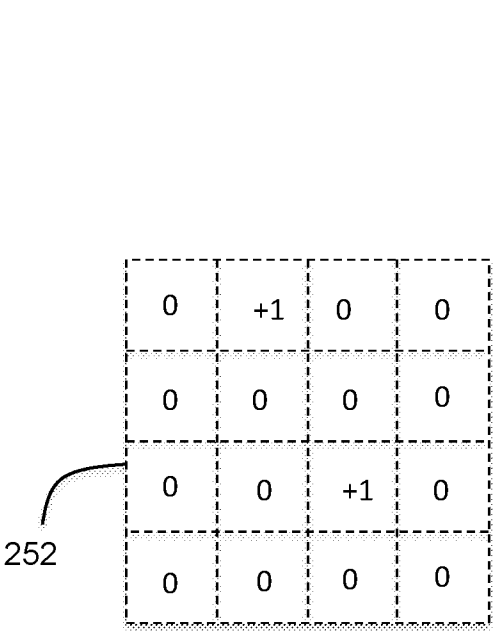
FIGS. 9A-9C show examples of image data masks.
Figure 9B:
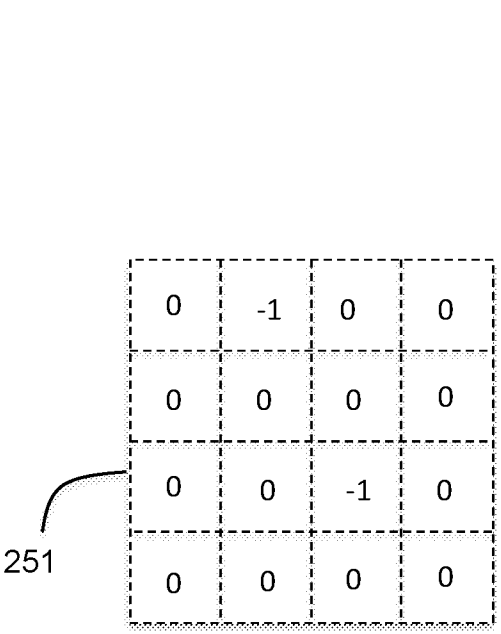
Figure 9A:
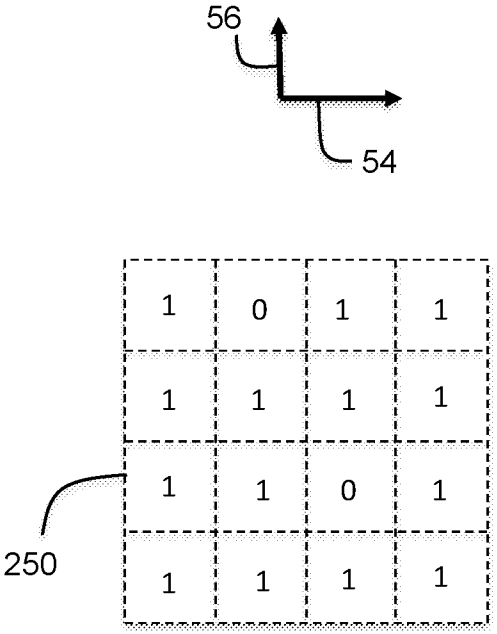

FIGS. 9A-9C illustrate several examples of image data masks. FIG. 9A represents an AND operation mask 250 that can be used to modify the dot layout pattern of FIG. 7B to provide the dot layout pattern of FIG. 7C. The image data corresponding to the dot pattern of FIG. 7B is ANDed with the AND operation mask 250 so that no dot will be printed in the second column of the first row and the third column of the third row, regardless of the input image data. Alternatively the decrement operation mask 251 shown in FIG. 9B can be used to modify the dot layout pattern of FIG. 7B to provide the dot layout pattern of FIG. 7C. The decrement operation mask 251 indicates the halftone cell locations where image data bits should be selectively removed, corresponding to mask entries of −1. Mask entries of 0 indicate the locations where the input dot layout is not to be modified. Similarly, the increment operation mask 252 shown in FIG. 9C can be used to modify the dot layout pattern of FIG. 7C to provide the dot layout pattern of FIG. 7B. The increment operation mask 252 indicates the halftone cell locations where image data bits should be selectively added, corresponding to mask entries of +1. Mask entries of 0 indicate the locations where the input dot layout is not to be modified.

Comparing FIGS. 3, 4 and 8 it can be seen that for the example shown in FIG. 3 an image data signal 183 is sent from image processing unit 13 via an electrical lead 138 to input data input pad 135 and from there to waveform selector 150. In the example shown in FIG. 8, an image data signal is sent through an image data mask generated by image data filtering mask generator 80 in order to produce a modified image data signal 185 that can have data bits that have been selectively added or removed. The modified image data signal 185 is sent via an electrical lead 139 to the input data input pad 135 and from there to waveform selector 150.

As described above, increasing or decreasing the number of printed pixels can be particularly advantageous if the manufacturing and temperature variations are so large that the drop volume cannot be kept sufficiently uniform through modifications to the fire pulse waveform and the heating pulse waveform. As shown in FIG. 8, image data filtering mask generator 80 includes a first input 81 connected to memory 11 corresponding to the at least one drop ejector correction factor 181 (FIG. 4). The drop ejector correction factor 181 is generally stable over the time required to process and print an image, although it can slowly change over the life of the printhead. Therefore it is straightforward to generate an image data filtering mask at substantially the same time that the halftoning and dithering algorithms of image processing unit 13 determine the nominal dot patterns in the various halftone cells that make up the image to be printed. For example, for the pagewidth printhead 105 of FIG. 5, two neighboring drop ejector array modules 109 and 110 can have different drop ejector correction factors 181, such that one drop ejector array module 110 can tend to eject larger drops than its neighbor drop ejector array module 109. In order to reduce the effects of image banding that can occur due to the transition between the corresponding larger printed dots and smaller printing dots, the image data filtering masks corresponding to the drop ejector array module 110 that tends to eject larger drops can be used to selectively remove image data bits so that the ink area coverage for the two neighboring drop ejector array modules 109 and 110 is substantially the same.

Adding or removing image data bits corresponds to printing a higher or lower number of dots for a halftone cell. In many instances, adding or subtracting an entire dot for each halftone cell is too large of a change. Halftoning methods that employ error diffusion, for example, handle this by distributing a quantization residual to neighboring pixels that have not yet been processed. For example, the removal of a dot at a particular location can result in a local ink deficit error, such that if a neighboring location did not previously meet a threshold for requiring a printed dot, the removal of the dot at the particular location can result in the need for a printed dot in the neighboring location. In order to reduce the effects of image artifacts, it is advantageous to use the image data filtering masks to add or remove image data bits at substantially the same time as the halftoning and dithering algorithms of the image processing unit 13 so that the dot patterns are well controlled. Depending on image size, resolution, and processing power, rendering an image for printing can take a few seconds for example. Since the drop ejector correction factor 181 is very stable over such a timeframe, there is no problem in using the image data filtering masks to add or remove image bits at substantially the same time as the halftoning and dithering algorithms used for rendering the image.

In the example shown in FIG. 8, image data filtering mask generator 80 further includes a second input 82 connected to the temperature sensor 170. The temperature near drop ejectors 125 affects the size of drops that they eject, with larger drops being ejected at higher temperature. The temperature of two drop ejector array modules 109 and 110 can vary somewhat according to their respective duty cycles due to waste heat that is dissipated during drop ejection. If the first of two drop ejector array modules 109 has been printing at high duty cycle and the second of the two drop ejector modules 110 has been printing at low duty cycle, the first drop ejector array module 109 can be at a higher temperature. Then if both drop ejector array modules 109 and 110 are supposed to print at substantially the same uniform image density, image banding can result due to the higher temperature of the first drop ejector array module 109. Image data filtering masks can be used to help compensate for such image banding. However, temperature on a drop ejector array module 109 or 110 can change within a time scale that is shorter than the time required to do image processing. In some embodiments, the image date filtering masks can be used on the rendered image at the time of printing to add or remove dots according to the temperature signal from the temperature sensor 170 that was received just prior to the time of printing and the known effect of temperature on drop volume. In other embodiments, the temperature at the time of printing can be approximated for each drop ejector array module 109 or 110 based on the temperature signals from the corresponding temperature sensors 170 at the time of image processing and the calculated duty cycle for printing by each drop ejector array module 109 or 110 during the interval between image processing and printing, according to the image data. In such embodiments, the image data filtering masks can be used as a function of temperature to add or remove image bits at substantially the same time as the halftoning and dithering algorithms used for rendering the image.

In some embodiments, temperature control (through heating pulse waveform control), drop size control (through pulse waveform control) and modification of dot numbers (through image data filtering masks) can all be used interactively to control the number and size of dots to be printed. For example, if adding a dot would result in too much ink in an area, the pulse waveform for that dot and optionally for neighboring dots can be modified to locally produce smaller sized dots.

Figure 10A:
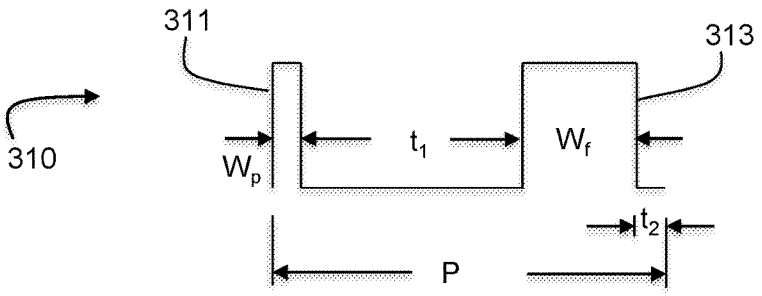
FIGS. 10A-10C show examples of fire pulse waveforms.
Figure 10B:
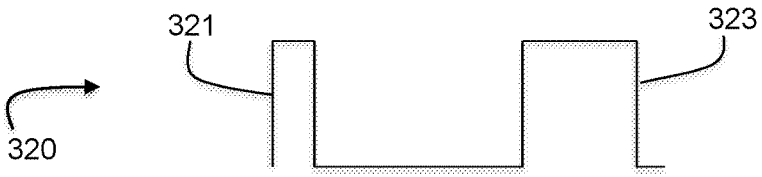
Figure 10C:
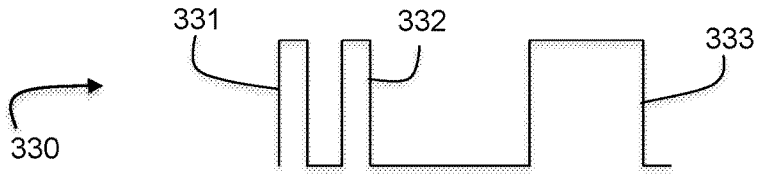

Examples of fire pulse waveforms are shown in FIGS. 10A through 10C. Fire pulse waveform 310 in FIG. 10A has a duration P and is used to fire a group of drop ejectors 125 that has been selected by logic circuit 141 (FIG. 2) for a particular print cycle. Fire pulse waveform 310 includes a precursor pulse 311 having a pulse width $W_p$ and a firing pulse 313 having a pulse width $W_f$. Firing pulse 313 begins after a first time delay $t_1$ following the precursor pulse 311. A second time delay $t_2$ is provided following firing pulse 313, such that the duration P of fire pulse waveform 310 is equal to $W_p+t_1+W_f+t_2$. The purpose of firing pulse 313 is to elevate the temperature of the ink near heating element 35 to an extent that a bubble is nucleated and grows to provide the force needed to eject a drop of ink through nozzle 32 (FIG. 1). The purpose of precursor pulse 311 is to locally heat the ink around each of the drop ejectors selected to eject a drop. The energy in the precursor pulse needs to be less than would be required to elevate the temperature of the ink to an extent that a bubble is nucleated on the heating element 35 (FIG. 1). Over the operating range of fire pulse waveform control, the greater the amount of local heating of the ink by precursor pulse 311, the larger the drop that will be ejected. Fire pulse waveform 320 in FIG. 10B is similar to fire pulse waveform 310, but precursor pulse 321 in fire pulse waveform 320 has a larger pulse width $W_f$ than precursor pulse 311 in fire pulse waveform 310 does. As a result, fire pulse waveform 320 would cause the ejection of a larger drop than fire pulse 310 for the same drop ejector operating at the same starting temperature.

Consider a given drop ejector where the temperature sensor 170 (FIG. 2) indicates that the temperature is $T_1$ at a first time and that the temperature is $T_2$ at a second time, where $T_1>T_2$. Providing a fire pulse waveform 310 at the first time and providing a fire pulse waveform 320 (having a greater pulse width $W_p$ for the precursor pulse 321 to provide additional local heating of the ink) at the second time will tend to compensate for the tendency of drop ejectors to eject larger drops at higher temperatures, so that the drop volume ejected at the second time is more similar to the drop volume ejected at the first time. Temperature correction factor 182 (FIG. 4) is used to determine how to modify the fire pulse waveform generated by fire pulse generator 40 (FIG. 4) in response to the signal from the temperature sensor 170.

Similarly, consider a first drop ejector 125 having a first drop ejector correction factor 181 (FIG. 4) that corresponds to a first drop volume at a given temperature, and a second drop ejector 125 having a second drop ejector correction factor 181 that corresponds to a second drop volume that is less than the first drop volume at the given temperature. Providing a fire pulse waveform 310 for the first drop ejector and providing a fire pulse waveform 320 (having a greater pulse width $W_p$ for the precursor pulse 321) for the second drop ejector will tend to compensate for the tendency of the second drop ejector to eject smaller drops, so that the drop volume ejected by the second drop ejector is more similar to the drop volume ejected by the first drop ejector.

Fire pulse waveform 330 shown in FIG. 10C illustrates another way to provide additional local heating of the ink relative to fire pulse waveform 310 of FIG. 10A. In this example, fire pulse waveform 330 includes two precursor pulses 331 and 332 that each have pulse widths that are similar to the pulse width $W_p$ of precursor pulse 311 of fire pulse waveform 310.

In general, generating a fire pulse waveform by the fire pulse generator 40 includes generating a firing pulse and at least one precursor pulse preceding the firing pulse. In order to ensure that the precursor pulses do not have sufficient energy to nucleate a bubble, the pulse width $W_f$ of the firing pulse is longer than any pulse width $W_p$ of the at least one precursor pulse. Generating the fire pulse waveform can include generating a number of precursor pulses, where the number of precursor pulses is determined by at least one of the temperature correction factor 182 and the at least one drop ejector correction factor 181. Generating the fire pulse waveform can include determining a pulse width $W_p$ of the at least one precursor pulse according to at least one of the temperature correction factor 182 and the at least one drop ejector correction factor 181.

Figure 11A:
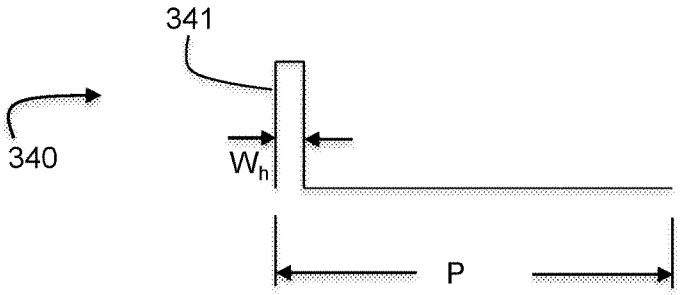
FIGS. 11A-11C show examples of heating pulse waveforms.
Figure 11B:
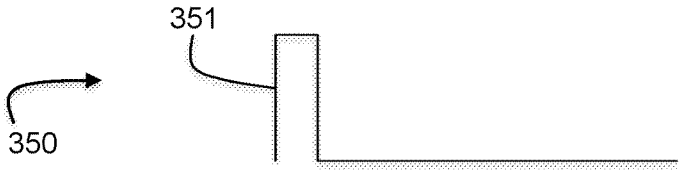
Figure 11C:
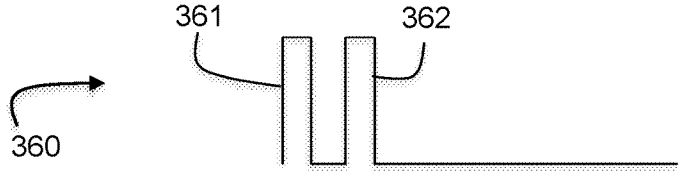

Examples of heating pulse waveforms are shown in FIGS. 11A through 11C. Heating pulse waveform 340 shown in FIG. 11A includes a single heating pulse 341 having a pulse width $W_h$. Heating pulse waveform 340 has a total duration of P corresponding to a print cycle, similar to the fire pulse waveforms shown in FIGS. 10A through 10C. Heating pulse waveform 350 shown in FIG. 11B includes a single heating pulse 351 having a pulse width that is greater than the pulse width $W_h$ of heating pulse 341, so that heating pulse waveform 350 provides a greater amount of heating than heating pulse waveform 340. Heating pulse waveform 360 shown in FIG. 11C includes two heating pulses 361 and 362, so that heating pulse waveform 360 provides a greater amount of heating than heating pulse waveform 340. It is important that no heating pulse has enough energy to nucleate a bubble, so the pulse widths $W_h$ of all heating pulses are shorter than the pulse width $W_f$ of a firing pulse such as firing pulse 313 of FIG. 10A. In general, because ejected drops carry off some of the energy in a fire pulse waveform, such as fire pulse waveform 310 of FIG. 10A, the total amount of energy in a heating pulse waveform is typically less than the total amount of energy in fire pulse waveform at a given temperature. In other words, the total of the pulse widths in a heating pulse waveform for a particular print cycle is typically less than the pulse widths of the firing pulse and the precursor pulses in a corresponding fire pulse waveform. As seen in FIG. 11C, generating a heating pulse waveform 360 can include generating a plurality of heating pulses 361 and 362. Temperature correction factor 182 (FIG. 4) can be used together with the signal from temperature sensor 170 to determine the pulse width $W_h$ of heating pulses that are generated by heating pulse generator 45.

Figure 12A:
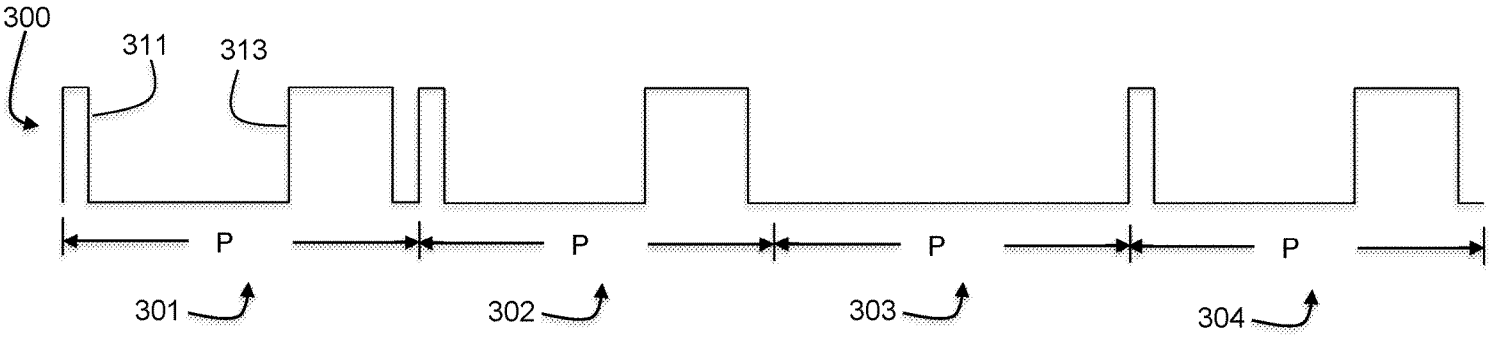
FIG. 12A shows a pulse train for an inkjet printing system that performs pulse waveform control to control drop volume.
Figure 12B:
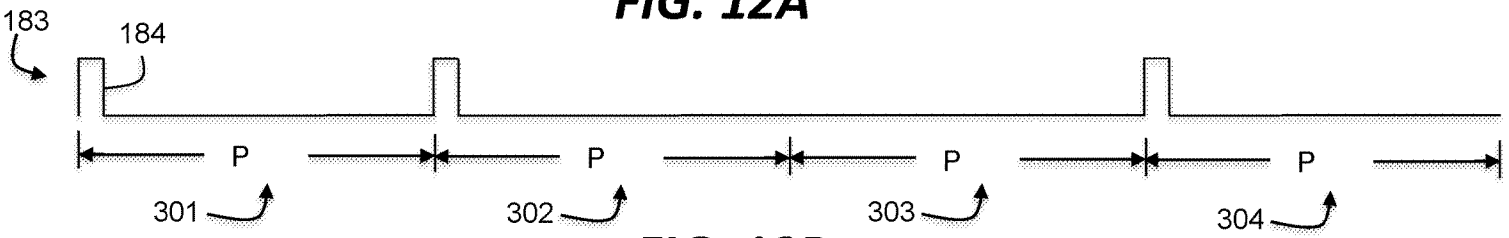
FIG. 12B shows a series of image data signals corresponding to the pulse train of FIG. 12A.

FIG. 12A shows a pulse train 300 for an inkjet printing system that performs pulse waveform control to control drop volume, but does not provide heating pulse waveforms for temperature control of the printhead. Pulse train 300 extends across four firing print cycles 301-304. During first print cycle 301 a first group of drop ejectors are selected by logic circuit 141 (FIG. 2). During second print cycle 302 a second group of drop ejectors are selected by logic circuit 141. During third print cycle 303 a third group of drop ejectors are selected by logic circuit 141. During fourth print cycle 304 a fourth group of drop ejectors are selected by logic circuit 141. FIG. 12B shows a series of image data signals 183 (FIG. 4) corresponding to pulse train 300. Print command pulses 184 occur during first print cycle 301, second print cycle 302 and fourth print cycle 304. No print command pulse occurs for third print cycle 303. As a result, pulse train 300 in FIG. 12A includes pulse waveforms having both a precursor pulse 311 and a firing pulse 313 for each of the first print cycle 301, second print cycle 302 and fourth print cycle 304, but no pulsing during third print cycle 303.

Figure 12C:
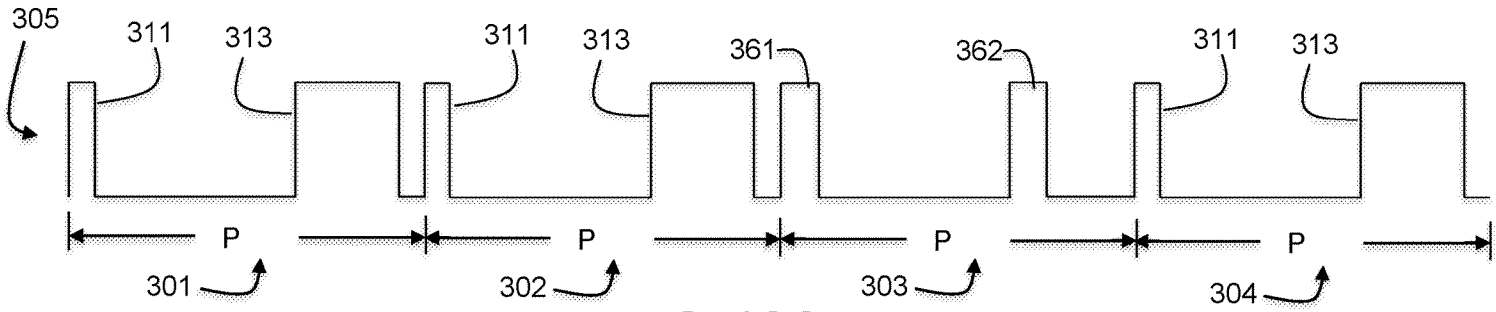
FIG. 12C shows a pulse train according to an embodiment that selects fire pulse waveforms or heating pulse waveforms corresponding to image data signals shown in FIG. 12B.

FIG. 12C shows a pulse train 305 according to an embodiment of an inkjet printing system 100 (FIG. 3) having a fire pulse generator 40, a heating pulse generator 45 and a waveform selector 150 for print cycles 301-304 corresponding to the series of image data signals 183 of FIG. 12B. Pulse train 305 of FIG. 12C is the same as pulse train 300 of FIG. 12A except during third print cycle 303 when a heating pulse waveform including first heating pulse 361 and second heating pulse 362 is provided in pulse train 305. In this example, first heating pulse 361 occurs at the beginning of third print cycle 303, in the same way that precursor pulses 311 occur at the beginning of first, second and fourth print cycles 301, 302 and 304. Second heating pulse 362 occurs in third print cycle 303 during a time interval corresponding to when firing pulse 313 occurs in first, second and fourth print cycles 301, 302 and 304, although second heating pulse 362 is shorter than firing pulse 313. As described above with reference to FIG. 4, if the image data signal 183 is high corresponding to a print command pulse 184 (indicating a print command for the drop ejector associated with heating element 35), then the waveform selector 150 selects the fire pulse waveform from fire pulse generator 40. If the image data signal 183 is low (indicating no print command for the drop ejector associated with heating element 35), then the waveform selector 150 selects the heating pulse waveform from heating pulse generator 45.

According to some embodiments, a method for firing a thermal inkjet drop ejector array module 110 for selectively ejecting drops can be summarized as follows: a) A signal is sent from temperature sensor 170 on the drop ejector array module 110 to a fire pulse generator 40 and to a heating pulse generator 45. b) A temperature correction factor signal 182 (FIG. 4) is sent to the fire pulse generator 40 and to the heating pulse generator 45. c) At least one drop ejector correction factor signal 181 is sent to the fire pulse generator 40. d) The fire pulse generator 40 generates a fire pulse waveform. e) The heating pulse generator 45 generates a heating pulse waveform. f) Logic circuit 141 (FIG. 3) selects a group of drop ejectors 125 for pulsing corresponding to a first print cycle 301. g) An image data signal 183 is sent to a waveform selector 150. h) The waveform selector 150 selects the fire pulse waveform when the image data signal 183 corresponds to a print command. i) The waveform selector 150 selects the heating pulse waveform when the image data signal 183 corresponds to no print command. j) The selected pulse waveform is sent to the thermal inkjet drop ejector array module 110 for pulsing the selected group of drop ejectors 125. k) At least steps f) through j) are repeated to fire additional groups of drop ejectors 125 during subsequent print cycles. Typically the duration P of each print cycle is only a few microseconds. During a stroke, a total of N print cycles is required to cycle sequentially through all of the groups of drop ejectors 125 on the drop ejector array module 110 during a total time of NP, which can be on the order of 100 microseconds. Over such a short time interval, the temperature recorded at temperature sensor 170 and the various correction factors typically remain substantially constant, such that a given fire pulse waveform and a given heating pulse waveform generated for first print cycle 301 can also selectively be used for all N print cycles in the stroke, as selected by waveform generator 150. In other words, within the N print cycles of the stroke, steps a) through e) typically do not need to be repeated.

As described above with reference to FIG. 8, sending an image data signal 183 to the waveform selector 150 can further include sending an image data signal through an image data mask to produce a modified image data signal, and sending the modified image data signal to the waveform selector 150. The firing pulse waveform is selected when the modified image data corresponds to a print command, and the heating pulse waveform is selected when the modified image data signal corresponds to a no print command. The phrase "sending an image data signal to a waveform selector 150" is understood herein to mean either sending an unmodified data signal or an image data signal that has been modified by an image data mask to the waveform selector 150.

As described above with reference to FIG. 10A, fire pulse waveform 310 has a duration P and is used to fire a group of drop ejectors 125 that has been selected by logic circuit 141 (FIG. 2) during a particular print cycle. Fire pulse waveform 310 includes a precursor pulse 311 having a pulse width $W_p$ and a firing pulse 313 having a pulse width $W_f$. Firing pulse 313 begins after a first time delay $t_1$ following the precursor pulse 311. A second time delay $t_2$ is provided following firing pulse 313, such that the duration P of fire pulse waveform 310 is equal to $W_p+t_1+W_f\ t_2$. During time delay $t_1$, the heat that was generated by precursor pulse 311 diffuses away from the heating element 35 (FIG. 1) and into the ink nearby. If $t_1$ is too short, the heating element 35 will not be sufficiently cooled prior to the firing pulse 313 and bubble nucleation and drop volume will not be well controlled. If a previous fire pulse waveform or heater pulse waveform is completed before initiating the subsequent fire pulse waveform or heater pulse waveform as shown in FIG. 12C, then the amount of time in a stroke required to sequentially cycle through all N groups of drop ejectors 125 on the drop ejector array module 110 is $NP=N(W_p+t_1+W_f\ t_2)$. The time required to cycle through all N groups of drop ejectors in a stroke sets a minimum time before a particular drop ejector can be fired again. In order to print a page, each drop ejector 125 must have the opportunity to print at each corresponding pixel location along the scan direction 56. If there are M pixel locations along the scan direction (where $M=L/R_s$ for a page of length L and a scan resolution $R_s$), then the amount of time to print a page will be greater than or equal to MNP.

Figure 13A:
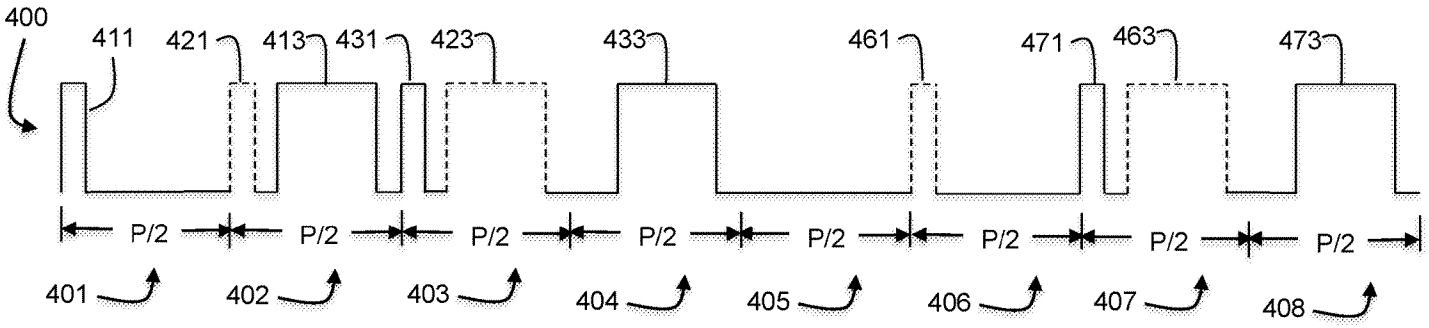
FIG. 13A shows an interleaved pulse train for an inkjet printing system.

One way to decrease the time required for printing a page, thereby increasing printing throughput, is to decrease the time required to sequentially cycle through all N groups of drop ejectors 125 on the drop ejector array module 110. However, there are minimum pulse width requirements for precursor pulses and firing pulses as well as minimum delay time requirements for well-controlled drop ejection. U.S. Pat. No. 5,917,509 discloses a method and apparatus for interleaving the precursor pulses and firing pulses for successive groups of drop ejectors 125. FIG. 13A shows an example of an interleaved pulse train 400 including only fire pulse waveforms (i.e. precursor pulses corresponding firing pulses) in an approach similar to that disclosed in '509. Interleaved pulse train 400 includes eight print cycles 401-408 that are arranged in two phases. Each of the eight print cycles has a duration P (similar to the four print cycles 301-304 shown in FIG. 12A). Odd numbered print cycles 401, 403, 405 and 407 in FIG. 13A are identical to print cycles 301, 302, 303 and 304 respectively in FIG. 12A and correspond to a first firing phase. During print cycle 401 a first group of drop ejectors 125 are selected by logic circuit 141 (FIG. 2). During print cycle 403 a third group of drop ejectors 125 are selected by logic circuit 141. During print cycle 405 a fifth group of drop ejectors 125 are selected by logic circuit 141. During print cycle 407 a seventh group of drop ejectors 125 are selected by logic circuit 141. Even numbered print cycles 402, 404, 406 and 408 correspond to a second firing phase and are interleaved between the odd numbered print cycles. In this example of two-fold interleaving, the even numbered print cycles of the second phase are delayed by a time interval P/2 with respect to the odd numbered print cycles of the first firing phase. During print cycle 402 a second group of drop ejectors 125 are selected by logic circuit 141 (FIG. 2). During print cycle 404 a fourth group of drop ejectors 125 are selected by logic circuit 141. During print cycle 406 a sixth group of drop ejectors 125 are selected by logic circuit 141. During print cycle 408 an eighth group of drop ejectors 125 are selected by logic circuit 141.

Figure 13B:
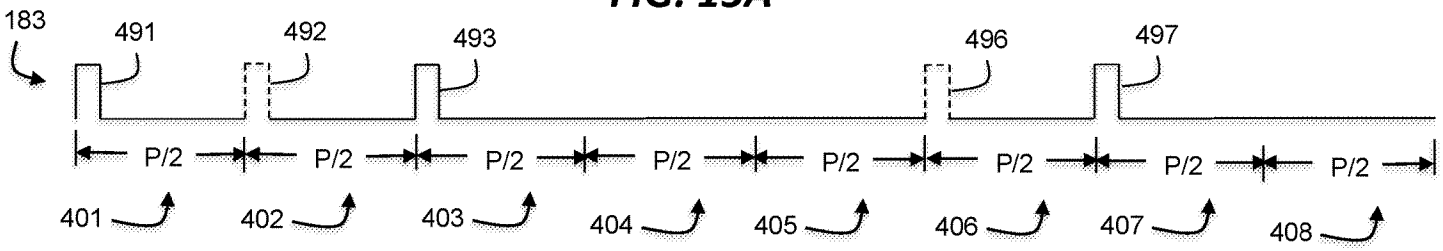
FIG. 13B shows a series of image data signals corresponding to the pulse train of FIG. 13A.

FIG. 13B shows a series of image data signals 183 (FIG. 4) corresponding to interleaved pulse train 400. Print command pulses 491, 493 and 497 correspond respectively with print cycles 401, 403 and 407 of the first firing phase. As a result, there are fire pulse waveforms provided for print cycles 401 (precursor pulse 411 and firing pulse 413), 403 (precursor pulse 431 and firing pulse 433) and 407 (precursor pulse 471 and firing pulse 473), but no fire pulse waveform provided for print cycle 405 in FIG. 13A. In addition, print command pulses 492 and 496 (shown as dashed lines in FIG. 13B) correspond to fire pulse waveforms provided for interleaved print cycles 402 and 406 of the second firing phase. In particular there is a precursor pulse 421 and a firing pulse 423 (shown as dashed lines) for interleaved print cycle 402, and a precursor pulse 461 and a firing pulse 463 (shown as dashed lines) for interleaved print cycle 406 in FIG. 13A.

Figure 13C:
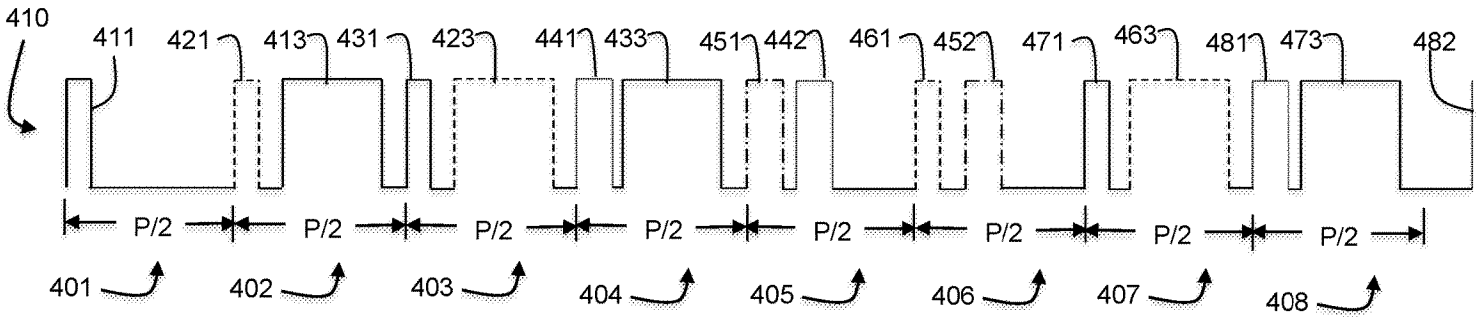
FIG. 13C shows an interleaved pulse train according to an embodiment that selects fire pulse waveforms or heating pulse waveforms corresponding to image data signals shown in FIG. 13B.

Although '509 discloses interleaving fire pulse waveforms for increasing printing throughput, '509 does not disclose, teach or suggest selectably interleaving fire pulse waveforms and heating pulse waveforms. FIG. 13C shows an interleaved pulse train 410 having interleaved fire pulse waveforms and heating pulse waveforms that are provided for print cycles 401-408 according to the series of image data signals 183 shown in FIG. 13B. In addition to the fire pulse waveforms described above with reference to interleaved pulse train 400 of FIG. 13A, interleaved pulse train 410 of FIG. 13C also includes heating pulse waveforms in print cycles 404, 405 and 408, corresponding to no print command pulses for print cycles 404, 405 and 408 in the series of image data signals 183 shown in FIG. 13B. In particular a heating pulse waveform in print cycle 404 includes a first heating pulse 441 and a second heating pulse 442; a heating pulse waveform in print cycle 405 includes a first heating pulse 451 and a second heating pulse 452; and a heating pulse waveform in print cycle 408 includes a first heating pulse 481 and a second heating pulse 482 (only the first part of which is shown in FIG. 13C). To help distinguish the various pulse waveforms in interleaved pulse train 410 in FIG. 13C, pulses corresponding to fire pulse waveforms for the odd-numbered print cycles are shown as solid lines; pulses corresponding to fire pulse waveforms for the interleaved even-numbered print cycles are shown as dashed lines; pulses corresponding to heating pulse waveforms for the odd-numbered print cycles are shown as dot-dashed lines; and pulses corresponding to heating pulse waveforms for the interleaved even-numbered print cycles are shown as dotted lines.

With reference to FIGS. 3, 4, 13B and 13C, a method for firing a thermal inkjet drop ejector array module for selectively ejecting drops and including interleaving of pulse waveforms for increasing printing throughput can be summarized as follows: a) A signal is sent from temperature sensor 170 on the drop ejector array module 110 to a fire pulse generator 40 and to a heating pulse generator 45. b) A temperature correction factor signal 182 (FIG. 4) is sent to the fire pulse generator 40 and to the heating pulse generator 45. c) At least one drop ejector correction factor signal 181 is sent to the fire pulse generator 40. d) The fire pulse generator 40 generates a first fire pulse waveform. e) The heating pulse generator 45 generates a first heating pulse waveform. f) The fire pulse generator 40 generates at least a second fire pulse waveform, such that the second fire pulse waveform has the same characteristics (same pulse widths and timing) as the first fire pulse waveform and is delayed by an offset time (such as P/2 in FIG. 13C) relative to the first fire pulse waveform. g) The heating pulse generator 45 generates at least a second heating pulse waveform, such that the second heating pulse waveform has the same characteristics (same pulse widths and timing) as the first heating pulse waveform and is delayed by an offset time (such as P/2 in FIG. 13C) relative to the first heating pulse waveform. h) Logic circuit 141 (FIG. 3) selects a first group of drop ejectors corresponding to a first firing phase (e.g. a first print cycle 401 in the first firing phase). i) An image data signal 183 is sent to a waveform selector 150. j) The waveform selector 150 selects the first fire pulse waveform when the image data signal 183 corresponds to a print command. k) The waveform selector selects the first heating pulse waveform when the image data signal corresponds to no print command. l) The selected pulse waveform is sent to the thermal inkjet drop ejector array module 110 for pulsing the first group of drop ejectors. m) Logic circuit 141 (FIG. 3) selects a second group of drop ejectors corresponding to at least a second firing phase (e.g. a second print cycle 402 in the second firing phase). n) An image data signal 183 is sent to the waveform selector 150. o) The waveform selector 150 selects the second fire pulse waveform when the image data signal corresponds to a print command. p) The waveform selector 150 selects the second heating pulse waveform when the image data signal corresponds to no print command. q) The selected pulse waveform is sent to the thermal inkjet drop ejector array module 110 for pulsing the second group of drop ejectors. r) At least steps m) through q) are repeated to fire additional groups of drop ejectors.

As shown in FIG. 13C, adjacent fire pulse waveform during print cycles 401 and 402 interleave such that no pulse of the first fire pulse waveform in the first print cycle 401 in the first phase (i.e. precursor pulse 411 and firing pulse 413) overlaps with pulses of the second fire pulse waveform (i.e. precursor pulse 421 and firing pulse 423) in the adjacent second print cycle 402 in the second phase. In addition, if print cycle 404 is considered to be a first print cycle and if firing phase 405 is considered to be a second print cycle, it can be seen that adjacent heating pulse waveforms during print cycles 404 and 405 in the first and second phases interleave such that no pulse of the first heating pulse waveform (i.e. first heating pulse 441 and second heating pulse 442) overlaps with pulses of the second heating pulse waveform (i.e. first heating pulse 451 and second heating pulse 452).

Furthermore, in the example shown in FIG. 13C, heating pulse waveforms in interleaved pulse train 410 are arranged such that first heating pulses 441, 451 and 481 are timed to occur at times corresponding to when a precursor pulse would occur in a firing pulse waveform, and second heating pulses 442, 452 and 482 are timed to occur at times corresponding to when a firing pulse would occur in a firing pulse waveform. Such an arrangement of heating pulse waveforms helps to ensure that heating pulse waveforms do not overlap with adjacent interleaved fire pulse waveforms. For example, if print cycle 403 is considered to be a first print cycle and if firing phase 404 is considered to be a second print cycle, it can be seen that the firing pulse waveform in print cycle 403 interleaves with the heating pulse waveform during print cycle 404 such that no pulse of the heating pulse waveform (i.e. first heating pulse 441 and second heating pulse 442) overlaps with pulses of the adjacent firing pulse waveform (i.e. precursor pulse 431 and firing pulse 433).

With reference also to FIG. 10A, generating the fire pulse waveforms in FIG. 13C includes generating a precursor pulse 311 that begins at a start of the firing phase and has a precursor pulse width $W_p$; generating the firing pulse 313 having a firing pulse width $W_f$ and beginning after a first time delay $t_1$ following the precursor pulse 311; and providing a second time delay $t_2$ following the firing pulse 313 before the beginning of the second firing phase, wherein the first time delay $t_1$ is greater than or equal to the precursor pulse width $W_p$ plus the firing pulse width $W_f$ plus the second time delay $t_2$. This ensures that the first time delay $t_1$ is long enough to accommodate an interleaved firing pulse waveform or an interleaved heating pulse waveform as described above without any overlap of pulses.

Figures 14A, 14B, 14C:
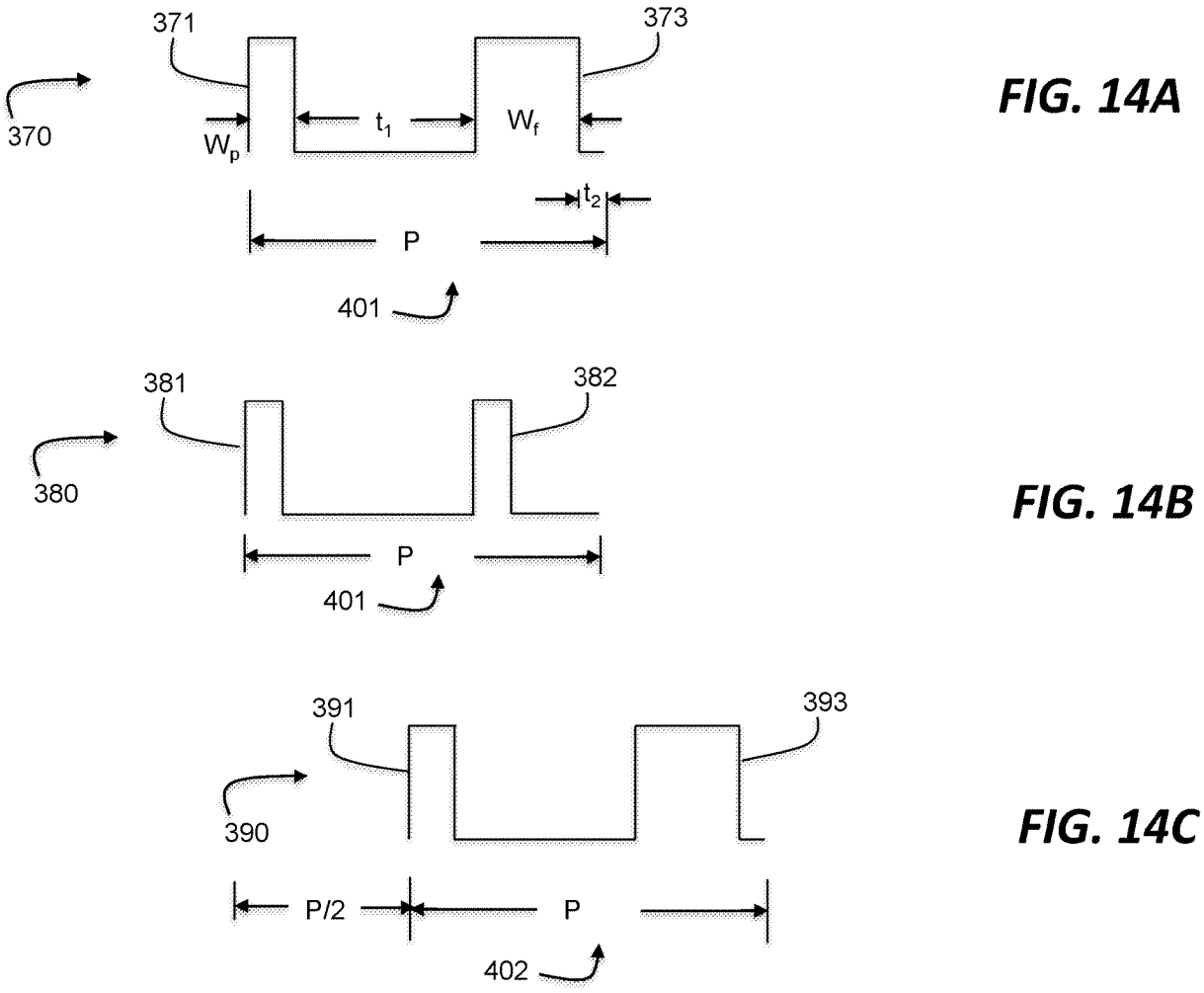
FIG. 14A shows a fire pulse waveform that can be selected for pulsing a first group of selected drop ejectors during a first firing phase.
FIG. 14B shows a heating pulse waveform that can be alternatively selected pulsing the first group of selected drop ejectors during the first firing phase.
FIG. 14C shows a fire pulse waveform that has been selected for pulsing a second group of selected drop ejectors during a second firing phase.

FIG. 14A shows a fire pulse waveform 370 having a precursor pulse 371 and a fire pulse 373, where precursor pulse 371 has a longest allowable pulse width $W_p$. Correspondingly first delay time $t_1$ for fire pulse waveform 370 is a shortest allowable first delay time before fire pulse 373. FIG. 14B shows a heating pulse waveform 380 having a first heating pulse 381 and a second heating pulse 382. Waveform selector 150 (FIG. 3) selects either fire pulse waveform 370 or heating pulse waveform 380 depending upon the image data signal 183 (FIG. 4) for a first print cycle 401 in the first phase for pulsing a first group of selected drop ejectors. Comparing FIG. 14A and FIG. 14B it can be seen that neither first heating pulse 381 nor second heating pulse 382 of heating pulse waveform 380 is timed to occur during a time corresponding to the first time delay $t_1$ of fire pulse waveform 370. In other words, generating the heating pulse waveform 380 includes generating at least one heating pulse such that none of the at least one heating pulses is timed to occur during a time corresponding to the first time delay $t_1$.

FIG. 14C shows a fire pulse waveform 390 having a precursor pulse 391 and a fire pulse 393 that has been selected for pulsing a second group of selected drop ejectors 125 during a second print cycle 402 in the second firing phase that is delayed by an offset time P/2. Fire pulse waveform 390 is timed to start during the first time delay $t_1$ of fire pulse waveform 370. In other words, sending the selected pulse waveform for pulsing the selected second group of drop ejectors during the second print cycle 402 in the second firing phase includes timing the selected pulse waveform 390 to start during the first time delay $t_1$ of the fire pulse waveform 370.

Figure 15:
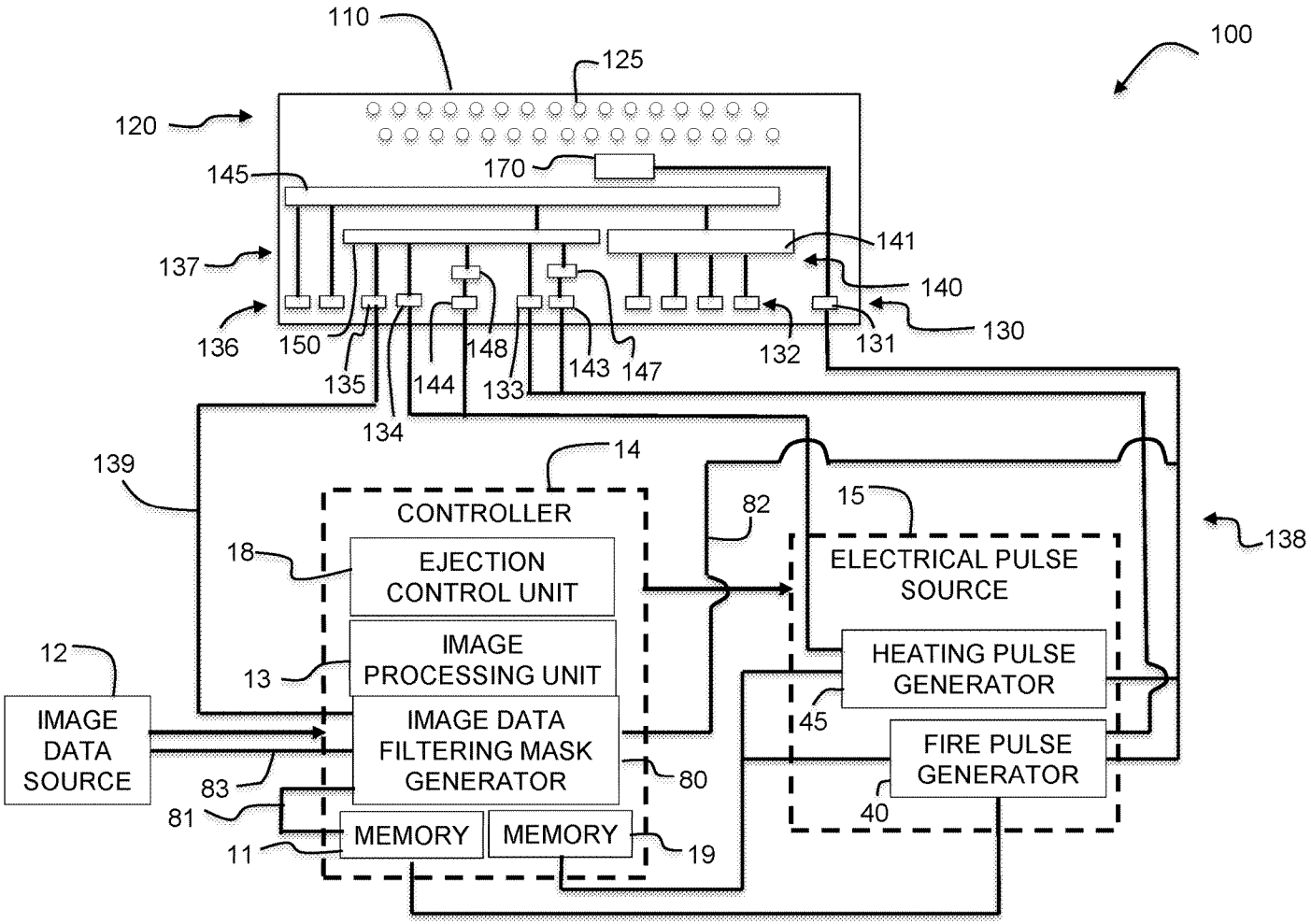
FIG. 15 is similar to FIG. 8 and is further configured for providing interleaved pulse trains.

FIG. 15 shows an embodiment of inkjet printing system 100 that is further configured to provide interleaved pulse trains, such as the interleaved pulse train 410 of FIG. 13C. The example shown in FIG. 15 is most similar to FIG. 8 and includes an image data filtering mask generator 80. Other embodiments (not shown) that are configured to provide interleaved pulse trains do not include an image data filtering mask generator 80 and are more similar to FIG. 3. In order to provide interleaved pulse trains, the drop ejector array module 110 in the example shown in FIG. 15 includes a fire pulse interleaving circuit 147 and a heating pulse interleaving circuit 148. Fire pulse interleaving circuit 147 and heating pulse interleaving circuit 148 can include delay circuits (not shown) that delay an incoming waveform by an offset time that is appropriate for the level of interleaving that is used. For the two-fold interleaving example discussed with reference to FIGS. 13C and 14C, the offset time between firing phases is P/2, i.e. half the duration of a print cycle. For three-fold interleaving (not shown) the offset time between each of the three firing phases is P/3. In FIG. 15, a fire pulse waveform is output from fire pulse generator 40 to both fire pulse input pad 133 and fire pulse input pad 143 via electrical leads 138. The fire pulse waveform that is received at fire pulse input pad 133 is sent to waveform selector 150 for print cycles of the first firing phase. The fire pulse waveform that is received at fire pulse input pad 143 is sent to waveform selector 150 for print cycles of the second firing phase and is delayed for interleaving by fire pulse interleaving circuit 147. Similarly, a heating pulse waveform is output from heating pulse generator 45 to both heating pulse input pad 134 and heating pulse input pad 144 via electrical leads 138. The heating pulse waveform that is received at heating pulse input pad 134 is sent to waveform selector 150 for print cycles of the first firing phase. The heating pulse waveform that is received at heating pulse input pad 144 is sent to waveform selector 150 for print cycles of the second firing phase and is delayed for interleaving by heating pulse interleaving circuit 148.

The invention has been described in detail with particular reference to certain preferred embodiments thereof, but it will be understood that variations and modifications can be effected within the spirit and scope of the invention.

The invention claimed is:

1. An inkjet printing system comprising:

an image data source for providing an image data signal;

a memory for storing at least one drop ejector correction factor;

a memory for storing a temperature correction factor;

at least one drop ejector array module, each drop ejector array module including:

a substrate;

an array of drop ejectors disposed on the substrate, each drop ejector including:

a nozzle;

an ink inlet;

a pressure chamber in fluidic communication with the nozzle and the ink inlet; and a heating element configured to selectively pressurize the pressure chamber for ejecting ink through the nozzle;

a logic circuit for sequentially selecting one or more drop ejectors in the drop ejector array; and a temperature sensor disposed on the substrate;

a fire pulse generator configured to receive signals corresponding to the temperature sensor, the at least one drop ejector correction factor, and the temperature correction factor and configured to output a fire pulse waveform;

a heating pulse generator configured to receive signals corresponding to the temperature sensor and the temperature correction factor and configured to output a heating pulse waveform; and a waveform selector for selecting either a fire pulse waveform or a heating pulse waveform based on the image data signal, the waveform selector including:

a first AND circuit having:

a first input corresponding to the fire pulse waveform;

a second input corresponding to the image data signal;

and a first AND circuit output;

a second AND circuit having:

a first input corresponding to the heating pulse waveform;

a second input corresponding to an inverted image data signal; and a second AND circuit output; and an OR circuit having:

a first input corresponding to the first AND circuit output;

a second input corresponding to the second AND circuit output; and an output waveform that is configured to be sent to the heating element in a drop ejector selected by the logic circuit.

2. The inkjet printing system of claim 1 including at least two drop ejector array modules, wherein:

the fire pulse generator is configured for each of the drop ejector array modules to receive signals corresponding to the temperature sensor, the at least one drop ejector correction factor, and the temperature correction factor for each of the drop ejector array modules and to output a fire pulse waveform to each of the corresponding drop ejector array modules; and the heating pulse generator is configured for each of the drop ejector array modules to receive signals corresponding to the temperature sensor and the temperature correction factor for each of the drop ejector array modules and to output a heating pulse waveform to each of the corresponding drop ejector array modules.

3. An inkjet printing system comprising:

an image data source for providing an image data signal;

a memory for storing at least one drop ejector correction factor;

a memory for storing a temperature correction factor;

at least one drop ejector array module, each drop ejector array module including:

a substrate;

an array of drop ejectors disposed on the substrate, each drop ejector including:

a nozzle;

an ink inlet;

a pressure chamber in fluidic communication with the nozzle and the ink inlet; and a heating element configured to selectively pressurize the pressure chamber for ejecting ink through the nozzle;

a logic circuit for sequentially selecting one or more drop ejectors in the drop ejector array;

a temperature sensor disposed on the substrate; and a waveform selector for selecting either a fire pulse waveform or a heating pulse waveform based on the image data signal; and an image data filtering mask generator configured to generate an image data mask, the image data filtering mask generator including a first input corresponding to the at least one drop ejector correction factor.

4. The inkjet printing system of claim 3, wherein the at least one drop ejector correction factor includes data corresponding to a heating element resistance.

5. The inkjet printing system of claim 3, wherein the at least one drop ejector correction factor includes data corresponding to a nozzle diameter.

6. The inkjet printing system of claim 3, wherein the at least one drop ejector correction factor includes data corresponding to an activation energy for ejecting drops from the drop ejectors in the drop ejector array module.

7. The inkjet printing system of claim 3, wherein the image data filtering mask generator further includes a second input corresponding to the temperature sensor.

8. The inkjet printing system of claim 3, wherein the image data filtering mask generator is configured to receive the image data signal from the image data source and selectively add or remove image data bits according to the image data mask.

9. A method for firing a thermal inkjet drop ejector array module for selectively ejecting drops comprising:

a) sending a signal from a temperature sensor on the drop ejector array module to a fire pulse generator and to a heating pulse generator;
b) sending a temperature correction factor signal to the fire pulse generator and to the heating pulse generator;
c) sending at least one drop ejector correction factor signal to the fire pulse generator;
d) generating a fire pulse waveform;
e) generating a heating pulse waveform;
f) selecting a group of drop ejectors for pulsing corresponding to a first print cycle;
g) sending an image data signal to a waveform selector;
h) selecting the fire pulse waveform when the image data signal corresponds to a print command;
i) selecting the heating pulse waveform when the image data signal corresponds to no print command;
j) sending the selected pulse waveform to the thermal inkjet drop ejector array module for pulsing the selected group of drop ejectors; and
k) repeating at least steps f) through j) to fire additional groups of drop ejectors during subsequent print cycles.

10. The method of claim 9, wherein generating the fire pulse waveform includes generating a firing pulse and at least one precursor pulse preceding the firing pulse.

11. The method of claim 10, wherein a pulse width of the firing pulse is longer than any pulse width of the at least one precursor pulses.

12. The method of claim 10, wherein generating the fire pulse waveform further includes generating a number of precursor pulses determined by at least one of the temperature correction factor and the at least one drop ejector correction factor.

13. The method of claim 10, wherein generating the fire pulse waveform further includes determining a pulse width of the at least one precursor pulse according to at least one of the temperature correction factor and the at least one drop ejector correction factor.

14. The method of claim 9, wherein generating the heating pulse waveform includes generating a plurality of heating pulses.

15. The method of claim 9, wherein generating the heating pulse waveform includes generating at least one heating pulse having a pulse width that is determined according to the temperature correction factor.

16. The method of claim 9, wherein sending an image data signal to the waveform selector further includes:

sending an image data signal through an image data mask to produce a modified image data signal; and
sending the modified image data signal to the waveform selector, wherein the firing pulse waveform is selected when the modified image data signal corresponds to a print command, and wherein the heating pulse waveform is selected when the modified image data signal corresponds to no print command.

17. A method for firing a thermal inkjet drop ejector array module for selectively ejecting drops comprising:

a) sending a signal from a temperature sensor on the drop ejector array module to a fire pulse generator and to a heating pulse generator;
b) sending a temperature correction factor signal to the fire pulse generator and to the heating pulse generator;
c) sending at least one drop ejector correction factor signal to the fire pulse generator;
d) generating a first fire pulse waveform;
e) generating a first heating pulse waveform;
f) generating at least a second fire pulse waveform, the second fire pulse waveform having the same characteristics as the first fire pulse waveform and delayed by a offset time relative to the first fire pulse waveform;
g) generating at least a second heating pulse waveform, the second heating pulse waveform having the same characteristics as the first heating pulse waveform and delayed by a offset time relative to the first heating pulse waveform;
h) selecting a first group of drop ejectors corresponding to a first firing phase;
i) sending an image data signal to a waveform selector;
j) selecting the first fire pulse waveform when the image data signal corresponds to a print command;
k) selecting the first heating pulse waveform when the image data signal corresponds to no print command;
l) sending the selected pulse waveform to the thermal inkjet drop ejector array module for pulsing the first group of drop ejectors;
m) selecting a second group of drop ejectors corresponding to at least a second firing phase;
n) sending an image data signal to the waveform selector;
o) selecting the second fire pulse waveform when the image data signal corresponds to a print command;
p) selecting the second heating pulse waveform when the image data signal corresponds to no print command;
q) sending the selected pulse waveform to the thermal inkjet drop ejector array module for pulsing the second group of drop ejectors; and
r) repeating at least steps m) through q) to fire additional groups of drop ejectors.

18. The method of claim 17, wherein the first fire pulse waveform and the second fire pulse waveform interleave such that no pulse of the first fire pulse waveform overlaps with pulses of the second fire pulse waveform.

19. The method of claim 17, wherein the first heating pulse waveform and the second heating pulse waveform interleave such that no pulse of the first heating pulse waveform overlaps with pulses of the second heating pulse waveform.

20. The method of claim 17, wherein generating the first fire pulse waveform further includes:

generating a precursor pulse that begins at a start of the first firing phase and that has a precursor pulse width;
generating the firing pulse having a firing pulse width and beginning after a first time delay following the precursor pulse; and providing a second time delay following the firing pulse before the beginning of the second firing phase, wherein the first time delay is greater than or equal to the precursor pulse width plus the firing pulse width plus the second time delay.

21. The method of claim 20, wherein generating the heating pulse waveform includes generating at least one heating pulse, wherein none of the at least one heating pulses is timed to occur during a time corresponding to the first time delay.

22. The method of claim 21, wherein sending the selected pulse waveform for pulsing the selected second group of drop ejectors during the second firing phase includes timing the selected pulse waveform to start during the first time delay.

* * * * *